US006900763B2

(12) United States Patent
Killen et al.

(10) Patent No.: US 6,900,763 B2
(45) Date of Patent: May 31, 2005

(54) ANTENNA SYSTEM WITH SPATIAL FILTERING SURFACE

(75) Inventors: William D. Killen, Satellite Beach, FL (US); Heriberto Delgado, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/193,338

(22) Filed: Jul. 11, 2002

(65) Prior Publication Data

US 2004/0008147 A1 Jan. 15, 2004

(51) Int. Cl.[7] ..... H01Q 1/38; H01Q 15/02

(52) U.S. Cl. ..... 343/700 MS; 343/756; 343/909; 333/202

(58) Field of Search ..... 343/700 MS, 756, 343/909, 853; 333/134, 202

(56) References Cited

U.S. PATENT DOCUMENTS

| | | | | | |
|---|---|---|---|---|---|
| 2,897,497 | A | | 7/1959 | Finneburgh, Jr. | 343/819 |
| 3,541,559 | A | | 11/1970 | Evans | 343/756 |
| 4,021,812 | A | | 5/1977 | Schell et al. | 343/753 |
| 4,097,868 | A | | 6/1978 | Borowick | 343/727 |
| 4,169,268 | A | | 9/1979 | Schell et al. | 343/909 |
| 4,186,400 | A | | 1/1980 | Cermignani et al. | 343/708 |
| 4,259,674 | A | | 3/1981 | Dragone et al. | 343/909 |
| 4,290,071 | A | | 9/1981 | Fenwick | 343/819 |
| 4,343,002 | A | | 8/1982 | Luh | 343/753 |
| 4,495,506 | A | | 1/1985 | Sasser et al. | 343/909 |
| 4,514,734 | A | | 4/1985 | Cermignani et al. | 343/708 |
| 4,638,324 | A | | 1/1987 | Hannan | 343/909 |
| 4,701,765 | A | * | 10/1987 | Arduini et al. | 343/897 |
| 4,812,855 | A | | 3/1989 | Coe et al. | 343/818 |
| 4,876,548 | A | | 10/1989 | Lopez | 342/368 |
| 4,916,453 | A | | 4/1990 | Costas | 342/368 |
| 4,970,634 | A | * | 11/1990 | Howell et al. | 362/342 |
| 5,103,241 | A | * | 4/1992 | Wu | 343/909 |
| 5,231,406 | A | | 7/1993 | Sreenivas | 343/700 |
| 5,260,968 | A | | 11/1993 | Gardner et al. | 375/1 |
| 5,382,959 | A | | 1/1995 | Pett et al. | 343/700 |
| 5,384,575 | A | * | 1/1995 | Wu | 343/909 |
| 5,455,594 | A | * | 10/1995 | Blasing et al. | 343/700 MS |
| 5,497,169 | A | * | 3/1996 | Wu | 343/909 |
| 5,543,815 | A | * | 8/1996 | Wu et al. | 343/909 |
| 5,563,614 | A | * | 10/1996 | Alden et al. | 343/701 |
| 5,612,706 | A | | 3/1997 | Podell | 343/818 |
| 5,949,387 | A | | 9/1999 | Wu et al. | 343/909 |
| 6,052,098 | A | | 4/2000 | Kllen et al. | 343/795 |
| 6,147,572 | A | * | 11/2000 | Kaminski et al. | 333/134 |
| 6,195,062 | B1 | | 2/2001 | Killen et al. | 343/795 |
| 6,208,316 | B1 | * | 3/2001 | Cahill | 343/909 |
| 6,218,978 | B1 | * | 4/2001 | Simpkin et al. | 342/5 |
| 6,396,451 | B1 | * | 5/2002 | Wu et al. | 343/756 |
| 6,563,472 | B2 | * | 5/2003 | Durham et al. | 343/781 P |
| 2001/0050654 | A1 | | 12/2001 | Killen et al. | 343/817 |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

An antenna system includes a ground plane and/or antenna elements forming an antenna array. A spatial filtering surface is positioned adjacent the antenna array through which electromagnetic radiation to or from the antenna array passes. The spatial filtering surface includes a dielectric substrate and a plurality of spaced, geometric configured, resonant elements printed on the dielectric substrate and configured and spaced from each other to have a resonant frequency to filter an electromagnetic field at a selected frequency with respect to an angle of incidence to the dielectric substrate. A dielectric filler is positioned between, above and below each resonant element printed on the dielectric substrate. A spatial filter taper transform is imparted when electromagnetic radiation passes therethrough. A standing wave is created between the ground plane and spatial filtering surface.

37 Claims, 51 Drawing Sheets

DIPOLE ELEMENT

CROSS DIPOLE

JERUSALEM CROSS DIPOLE

TRIPOLE ELEMENT

ANCHOR ELEMENT

CIRCULAR RING ELEMENT

ELLIPTICAL RING ELEMENT

CONCENTRIC RING ELEMENT

LOADED TRIPOLE

NESTED TRIPOLES

SQUARED RING ELEMENT

CONCENTRIC SQUARED RING ELEMENT

RECTANGULAR RING ELEMENT

HEXAGON ELEMENT

ELLIPTICAL HEXAGON ELEMENT

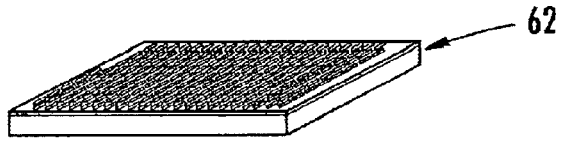
FIG. 5a.
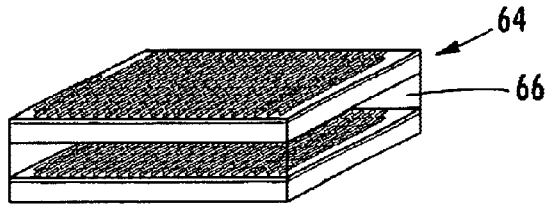
FIG. 5b.
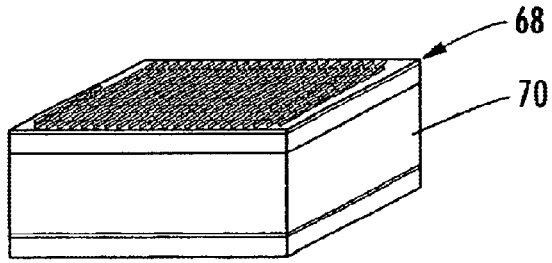
FIG. 5c.
FIG. 6.
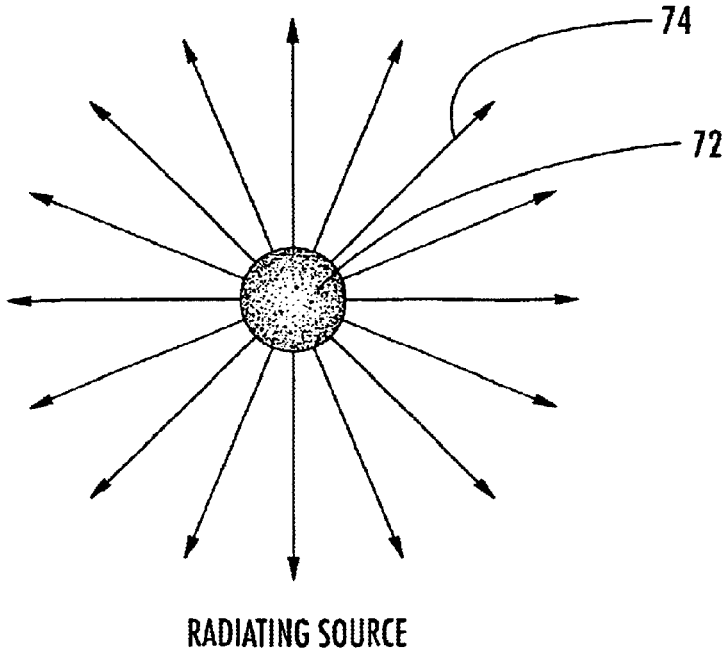

THE RADIATION OF THE SOURCE
IS FILTERED SPATIALLY WITH THE SFS TAPER
TRANSFORM

SOURCE RADIATION MODIFIED
BY THE USE OF AN SFS

LEGEND

| ELEMENT(S) | TAPER MAGNITUDE | TAPER PHASE |
|---|---|---|
| 9 | -16 dB | 0 DEGREES |
| 8,10 | -15.87 dB | 0 DEGREES |
| 7,11 | -15.45 dB | 0 DEGREES |
| 6,12 | -14.73 dB | 0 DEGREES |
| 5,13 | -13.64 dB | 0 DEGREES |
| 4,14 | -12.07 dB | 0 DEGREES |
| 3,15 | -9.8 dB | 0 DEGREES |
| 2,16 | -6.36 dB | 0 DEGREES |
| 1,17 | 0 dB | 0 DEGREES |

LEGEND

| ELEMENT | COLOR | TAPER PHASE |
|---|---|---|
| 1 | | 0 DEGREE |
| 2 | | -46.6 DEGREES |
| 3 | | -93.2 DEGREES |
| 4 | | -139.8 DEGREES |
| 5 | | -186.35 DEGREES |
| 6 | | -232.9 DEGREES |
| 7 | | -279.5 DEGREES |
| 8 | | -326.1 DEGREES |
| 9 | | -372.7 DEGREES |
| 10 | | -419.3 DEGREES |
| 11 | | -465.9 DEGREES |
| 12 | | -512.4 DEGREES |
| 13 | | -559.0 DEGREES |
| 14 | | -605.6 DEGREES |
| 15 | | -652.2 DEGREES |
| 16 | | -698.8 DEGREES |
| 17 | | -745.4 DEGREES |

FIG. 49a.
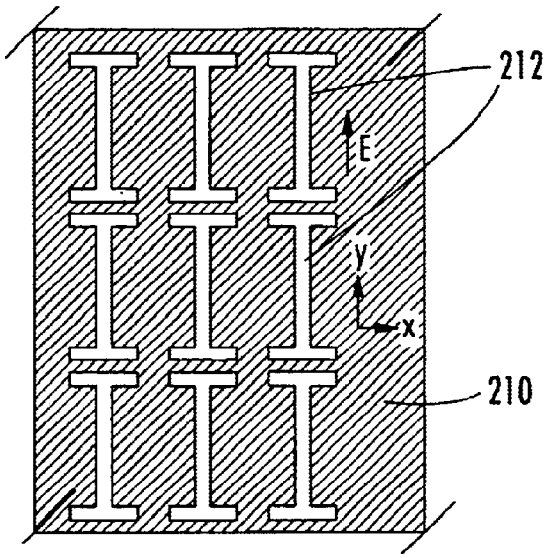
FIG. 49b.
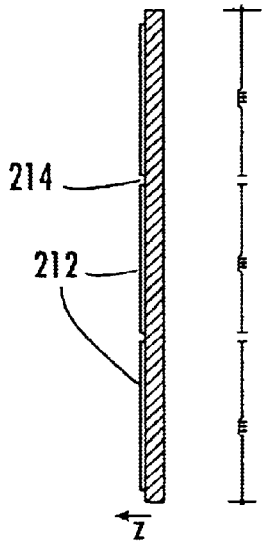
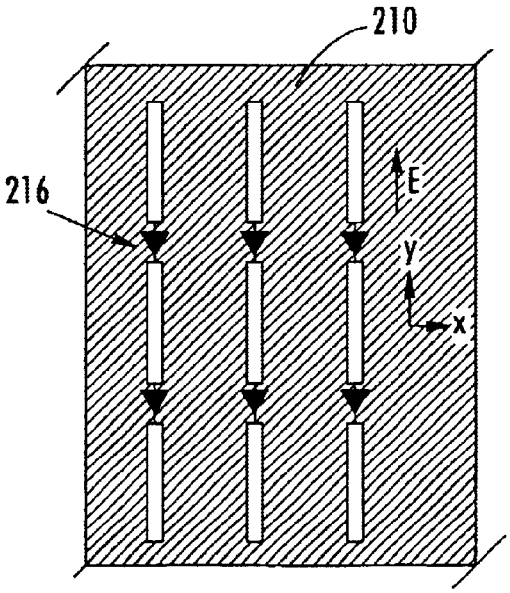
FIG. 49c.
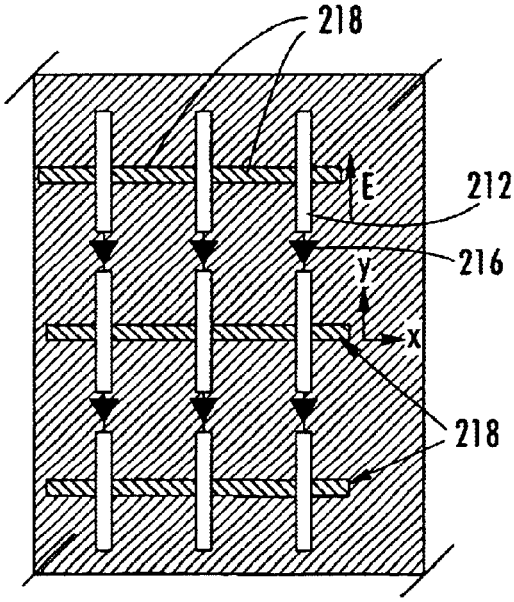
FIG. 49d.

FIG. 53a.
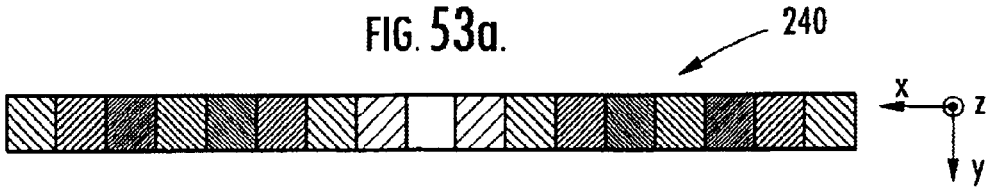
FIG. 53b.
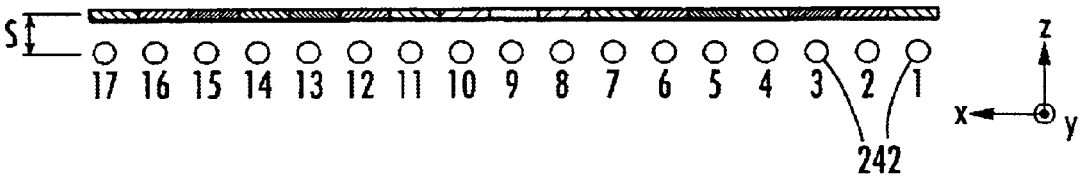
LEGEND
| ELEMENT(S) | TAPER MAGNITUDE | TAPER PHASE |
|---|---|---|
| 9 | 0 dB | 0 DEGREES |
| 8,10 | -6.36 dB | 0 DEGREES |
| 7,11 | -9.8 dB | 0 DEGREES |
| 6,12 | -12.07 dB | 0 DEGREES |
| 5,13 | -13.64 dB | 0 DEGREES |
| 4,14 | -14.73 dB | 0 DEGREES |
| 3,15 | -15.45 dB | 0 DEGREES |
| 2,16 | -15.87 dB | 0 DEGREES |
| 1,17 | -16 dB | 0 DEGREES |
FIG. 53.

ANTENNA SYSTEM WITH SPATIAL FILTERING SURFACE

FIELD OF THE INVENTION

The present invention relates to the field of antenna systems, and, more particularly, to an antenna system having a spatial filtering surface for imparting a spatial filter taper transform.

BACKGROUND OF THE INVENTION

Frequency selective surface (FSS) filters are commonly used with antenna systems for providing multiple frequency rejection bands. Some of these filters use dielectric substrates or other materials that are substantially transparent to electromagnetic signal transmissions. Some of the surfaces suggest elements that provide a number of frequency rejection bands. Other similar devices are formed as spatial filters that are positioned separate from an antenna or phased array antenna system. The filters are situated in the aperture plane for reducing the amplitudes of spatial sinusoidal field distribution in the main beam region of a radiation pattern associated with the antenna system. Some of the devices also include radiation absorbing material placed within the aperture plane or various elements within the aperture plane for modifying amplitude or filtering frequencies.

In commonly assigned U.S. Pat. Nos. 6,052,098 and 6,195,062, parasitic antenna elements are provided adjacent to an array of dipole elements of an antenna and formed as patterned conductor elements on one surface of a thin dielectric substrate. Feed elements for the driven dipole array comprise patterned conductor elements formed on an opposite surface of the substrate. The feed elements have a geometry with a mutually overlapping projection relationship with the conductors of the driven dipole elements to form a matched impedance transmission line to the dielectric substrate with the pattern dipole elements. Further addition of dipoles to that structure could provide a spatial filter surface for enhancing the reduction of sidelobes.

It would be more advantageous, however, if a spatial filtering surface can provide for magnitude and phase tapers and be applied to many different types of reflector antenna and phased antenna arrays made of elements with uniform weights where electronics required for the weights and amplitude and phase do not have to be implemented at the array level.

SUMMARY OF THE INVENTION

The present invention allows the application of a spatial filtering surface for increasing antenna efficiency and allowing the aperture field of an antenna to be tapered using spatial filtering surfaces. The spatial filtering surface of the present invention can replace or enhance the function of traditional antenna array element weights and provide for magnitude and phase tapers.

In one aspect of the present invention, an antenna system includes a ground plane and a plurality of antenna elements forming an antenna array. A spatial filtering surface is positioned adjacent to the antenna array through which electromagnetic radiation to or from the antenna array passes. The spatial filtering surface includes a dielectric substrate and a plurality of spaced, geometric configured, resonant elements printed on the dielectric substrate and configured and spaced from each other to have a resonant frequency to filter an electromagnetic field at a selected frequency with respect to an angle of incidence to the dielectric substrate. A dielectric filler is positioned between, above and below each resonant element printed on the dielectric substrate. A spatial filter taper transform is imparted when electromagnetic radiation passes therethrough and a standing electromagnetic wave is created between the ground plane or the antenna and the spatial filtering surface.

In accordance with one aspect of the present invention, the resonant elements are formed by a plurality of wire elements printed on the dielectric substrate. The wire elements can be configured as hexagons.

In yet another aspect of the present invention, a metallic layer is disposed on the dielectric layer and the resonant elements are formed as geometric configured slots within the metallic layer. The geometric configured slots can be formed as hexagons.

In still another aspect of the present invention, the dielectric layer comprises a plurality of dielectric layers. A dielectric layer can also overlay the resonant elements and be formed from a plurality of dielectric layers. The filler used in the present invention can be formed from an adhesive film or could be formed as an air gap between, above and below resonant elements.

In yet another aspect of the present invention, the spatial filtering surface can be formed as a multilayer spatial filtering surface using a plurality of spaced dielectric substrates each forming a spatial filtering surface layer having the resonant elements printed thereon. An air gap can be formed between the spatial filtering surface layers or a dielectric layer can be positioned between the spatial filtering surface layers. The distance between the spatial filtering surface layers, the dielectric constant of dielectric substrates, and the permeability of dielectric substrates can be chosen to impart a desired spatial filter surface taper transform.

BRIEF DESCRIPTION OF THE DRAWINGS

Other objects, features and advantages of the present invention will become apparent from the detailed description of the invention which follows, when considered in light of the accompanying drawings in which:

FIG. 5A is an isometric view of a one-layer spatial filtering surface.

FIG. 5B is an isometric view of a two-layer spatial filtering surface separated by an air gap.

FIG. 5C is another isometric view of a two-layer spatial filtering surface separated by a dielectric layer used to control how the electromagnetic fields are attenuated spatially, referred to as the spatial filtering surface transform taper function.

FIG. 6 is a fragmentary plan view of a radiating source, such as an antenna element, where the pointing vector is shown in a radial direction from the radiating source.

FIGS. 49A–D show an active spatial filtering surface device for an antenna array.

FIG. 49A shows a passive resonant grid formed by loaded dipole elements.

FIG. 49B shows an equivalent circuit for loaded dipoles where the gaps are modeled as capacitors and the wire element as an inductor.

FIG. 49C shows an active version of the resonant loaded dipoles with varactor diodes connecting the dipoles.

FIG. 49D shows an active version of the resonant loaded dipoles with varactor diodes connecting the dipoles, including bias lines for the varactors.

FIGS. 53A and 53B are views similar to FIGS. 40A and 40B and showing a spatial filtering surface used to modify the near field electric field of an antenna array where the coupling induced weight for each spatial filter section is 0.5 volts with a phase of −130°.

DETAILED DESCRIPTION OF THE PREFERRED EMBODIMENTS

Figure 1:
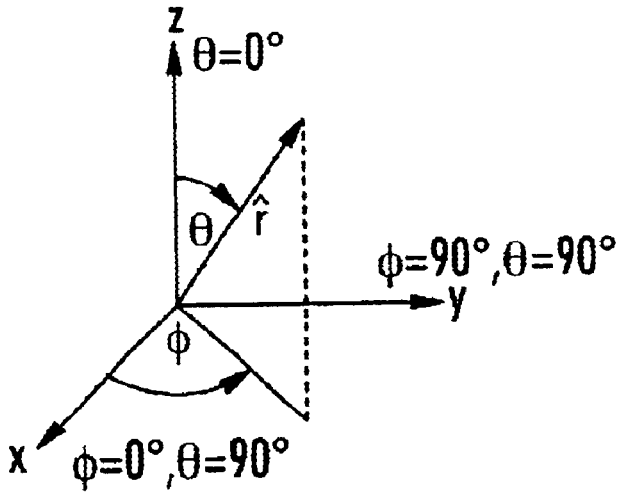
FIG. 1 is a graphical view illustrating the spherical coordinate system and showing the direction of the electromagnetic field components of a radiator, such as an antenna element.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

In accordance with the present invention, the Spatial Filtering Surface (SFS) is a device that can filter electromagnetic fields spatially, in a three dimensional space. The spatial filtering surface of the present invention can be used near a receiving antenna, a radiator, or as a stand-alone structure. The spatial filtering surface device can be either passive or active as will be explained in detail below.

To better explain the basic ideas of the spatial filtering surface of the present invention, a general background of the spatial filtering surface and frequency selective surface (FSS) as known to those skilled in the art is set forth. In the case of a receiving antenna or a radiator in the proximity of a spatial filtering surface, the near electromagnetic fields of the radiator are given by $$\overline{E}^i(r,\theta,\phi)=\hat{r}E_r^i(r,\theta,\phi)+\hat{\theta}E_0^i(r,\theta,\phi)+\hat{\phi}E_\phi^i(r,\theta,\phi)\ \text{volts/meter},$$

$$\overline{H}^i(r,\theta,\phi)=\hat{r}H_r^i(r,\theta,\phi)+\hat{\theta}H_0^i(r,\theta,\phi)+\hat{\phi}H_\phi^i(r,\theta,\phi)\ \text{Amperes/meter},$$

The power flux per unit area in the near field is given by the pointing vector $$\overline{P}^i(r,\theta,\phi)=\frac{1}{2}\mathrm{Re}\left(\overline{E}^i(r,\theta,\phi)\times\left(\overline{H}^i(r,\theta,\phi)\right)^*\right)\ \text{Watts/meter}^2.$$

In a typical antenna, most of the energy is transferred in the radial direction, and this energy is received or transmitted in the radial direction, hence the pointing vector in the redirection is given by $$P_r^i(r,\theta,\phi)=\hat{r}\cdot\bar{P}_i(r,\theta,\phi)\ \text{Watts/meter}^2.$$

In accordance with the present invention, the spatial filtering surface is a device which filters the electromagnetic fields as a function of radial and angular coordinates given by the unit vectors $\hat{r}$, $\hat{\theta}$ and $\hat{\phi}$. The spatial filtering surface transmission and reflection coefficients are:

$$\overline{T}^{SFS}(r,\theta,\phi)=\hat{r}\hat{r}T_r^{SFS}(r,\theta,\phi)+\hat{\theta}\hat{\theta}T_\theta^{SFS}(r,\theta,\phi)+\hat{\phi}\hat{\phi}T_\phi^{SFS}(r,\theta,\phi),$$

$$\Gamma^{SFS}(r,\theta,\phi)=\hat{r}\hat{r}\Gamma_r^{SFS}(r,\theta,\phi)+\hat{\theta}\hat{\theta}\Gamma_\theta^{SFS}(r,\theta,\phi)+\hat{\phi}\hat{\phi}\Gamma_\phi^{SFS}(r,\theta,\phi),$$

respectively, hence the fields transmitted through the spatial filtering surface are $$\overline{E}^t(r,\theta,\phi)=\overline{E}^i(r,\theta,\phi)\cdot\overline{T}^{SFS}(r,\theta,\phi)\ \text{Volts/meter},$$

$$\overline{H}^t(r,\theta,\phi)=\overline{H}^i(r,\theta,\phi)\cdot\overline{T}^{SFS}(r,\theta,\phi)\ \text{Amperes/meter},$$

and the fields reflected from the spatial filtering surface are, $$\overline{E}^{i+r}(r,\theta,\phi)=\overline{E}^i(r,\theta,\phi)+\overline{E}^i(r,\theta,\phi)\cdot\Gamma^{SFS}(r,\theta,\phi)\ \text{volts/meter},$$

$$\overline{H}^{i+r}(r,\theta,\phi)=\overline{H}^i(r,\theta,\phi)+\overline{H}^i(r,\theta,\phi)\cdot\Gamma^{SFS}(r,\theta,\phi)\ \text{Amperes/meter},$$

The total fields between the receiving antenna or the radiator and the spatial filtering surface are the sum the radiator incident fields and the fields reflected from the spatial filtering surface, given by:

$$\overline{E}^{i+r}(r,\theta,\phi)=\overline{E}^i(r,\theta,\phi)+\overline{E}^i(r,\theta,\phi)\cdot\overline{\Gamma}^{SFS}(r,\theta,\phi)\ \text{Volts/meter},$$

$$\overline{H}^{i+r}(r,\theta,\phi)=\overline{H}^i(r,\theta,\phi)+\overline{H}^i(r,\theta,\phi)\cdot\overline{\Gamma}^{SFS}(r,\theta,\phi)\ \text{Amperes/meter},$$

where the reflection $\overline{\Gamma}^{SFS}(r,\theta,\phi)$ and transmission $\overline{T}^{SFS}(r,\theta,\phi)$ coefficients are calculated by taking into account the electromagnetic interaction or electromagnetic coupling between the receiving antenna or the radiator and the spatial filtering surface. The spatial filtering surface transmission and reflection coefficients affect both the magnitude and the phase of the resultant electromagnetic field. Throughout this description, the spatial filtering surface transform is defined as the transformation of the electromagnetic fields resulting from the reflection and transmission coefficients of the spatial filtering surface.

The spatial filtering surface transform spatially filters the fields generated by a radiator or a receiving antenna in order to achieve a specific field distribution at a location in space, which includes the fields transmitted and reflected by the spatial filtering surface. The transformed fields can be in both the near or the far fields of the radiator.

The pointing vector in the radial direction of the radiator-spatial filtering surface device is given by $$P_r(r,\theta,\phi)=\hat{r}\cdot\frac{1}{2}\mathrm{Re}\left(\overline{E}^{s+SFS}(r,\theta,\phi)\times\left(\overline{H}^{s+SFS}(r,\theta,\phi)\right)^*\right)\ \text{Watts/meter}^2.$$

When the spatial filtering surface is used in combination with antennas, sidelobe reduction can be achieved by using the spatial filtering surface, while increasing the antenna gain. In receiving antenna arrays the grating lobes can be filtered, and the sidelobe envelopes can be reduced. In reflector antennas, the antenna feed radiation pattern can be shaped, and the reflector antenna far field can be modified by lowering the side lobe levels, lowering the sidelobe envelope, or increasing the gain. Also, spatial filtering surfaces can be integrated with the elements of an antenna array for controlling more precisely the antenna element radiation pattern.

Initially, a frequency selective surface (FSS) can be explained as a device that is used as a departure point for the implementation of the spatial filtering surface. Frequency selective surfaces are used to pass the fields at a group of frequencies while reflecting the fields at another group of frequencies. These surfaces are designed such that transmitted and reflected fields are nearly invariant with the angle of incidence. Frequency selective surfaces are often used in sub-reflector antennas, radomes, and similar devices known to those skilled in the art. In contrast, the spatial filtering surfaces of the present invention filter the fields at a frequency with respect to angle of incidence. These surfaces can be used in antenna sidelobe reduction, antenna radiation pattern shaping and other applications as suggested by those skilled in the art. The spatial filtering surface technology borrows frequency selective surface techniques as a point of departure. However, as the spatial filtering surface technology advances, the physical resemblance with the frequency selective surface technology may begin to disappear.

The spatial filtering surface is preferably formed of a closely spaced groups of elements. These elements, which have been used traditionally for frequency selective surfaces, can have different shapes, and can be hexagons, rings, tripoles or any other resonant element configuration. Examples of these elements are shown in FIGS. 2A–2O.

Figure 2A:
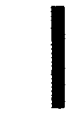
FIGS. 2A–2O are fragmentary drawing views of different elements (wire or slots) that can be used for frequency selective surfaces and spatial filtering surfaces in accordance with the present invention.
Figure 2B:
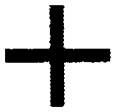
Figure 2C:
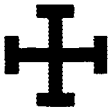
Figure 2D:
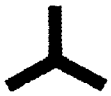
Figure 2E:
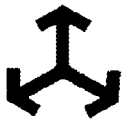

FIG. 2A illustrates a dipole element and FIG. 2B illustrates a cross dipole element. FIG. 2C shows a Jerusalem cross dipole and FIG. 2D shows a tripole element. FIG. 2E shows an anchor element that is similar to the tripole element.

Figure 2F:
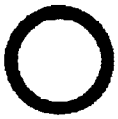
Figure 2G:
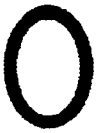
Figure 2H:
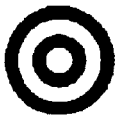
Figure 2I:
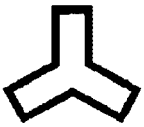
Figure 2J:
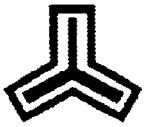
Figure 2K:
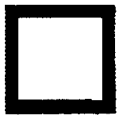
Figure 2L:
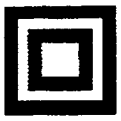
Figure 2M:
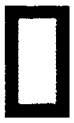
Figure 2N:
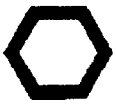
Figure 2O:
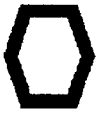

A circular ring element is shown in FIG. 2F and an elliptical ring element is shown in FIG. 2G. FIG. 2H shows a concentric ring element. FIG. 2I and FIG. 2J show a loaded tripole where FIG. 2J is nested with a tripole element. A squared ring element is shown in FIG. 2K followed by a concentric squared ring element in FIG. 2L. FIG. 2M shows a rectangular ring element followed by a hexagon element (FIG. 2N) and an elliptical hexagon element (FIG. 2O).

Figure 3A:
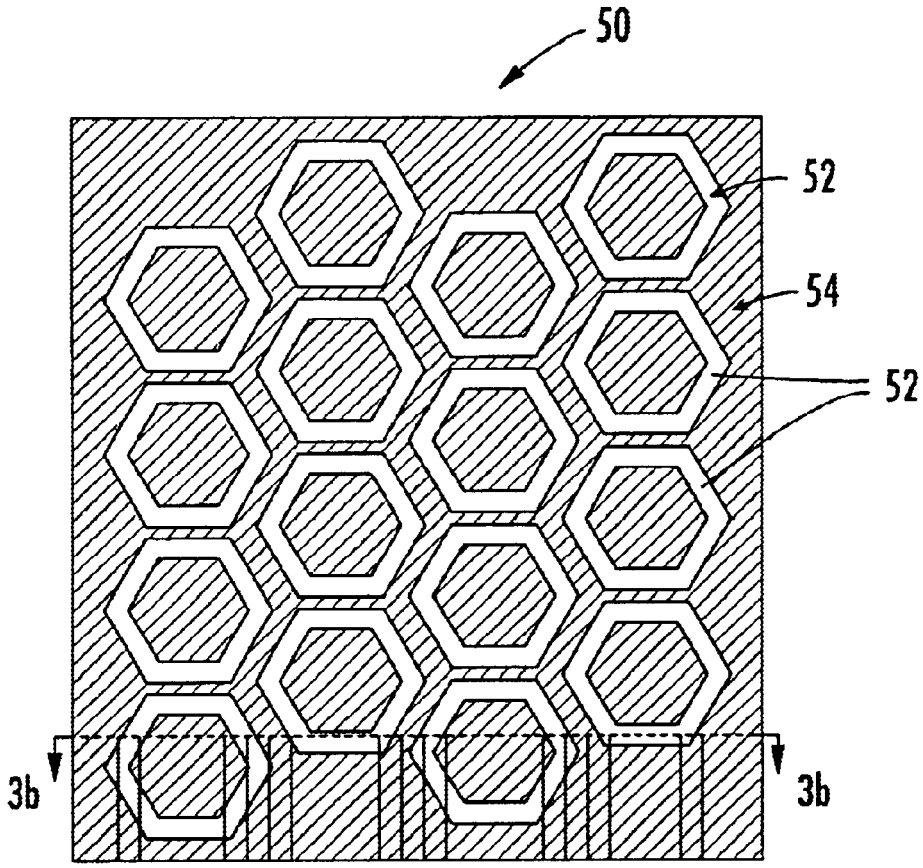
FIG. 3A is a top plan view of a wire element single layer formed by a metallic wire surface printed on a dielectric substrate as an example of a single layer spatial filtering surface, using wire hexagon elements.
Figure 3B:
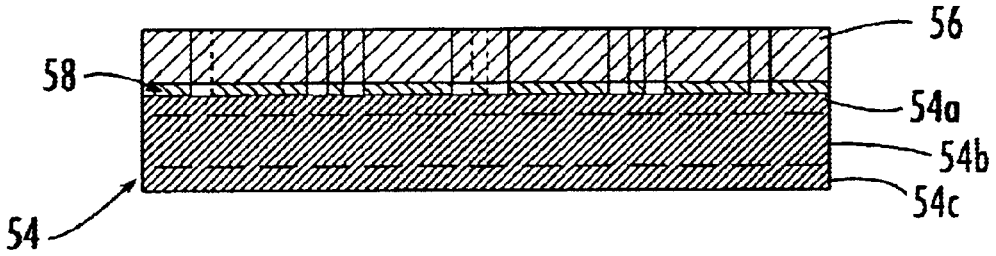
FIG. 3B is a sectional view taken along line 3B—3B of FIG. 3A and showing the dielectric substrate, wire hexagon elements, and dielectric substrate formed by one or more layers of dielectrics as a lower layer, including a filler material located between, above and below wire elements.

The spatial filtering surface structures can be formed with wire or slot elements. An example of a wire structure is shown in FIGS. 3A and 3B. FIG. 3A shows a front view of a single layer spatial filter surface 50 formed of wire hexagon elements 52 that could be formed by a metallic surface printed on a lower dielectric substrate 54. Another dielectric substrate 56 may or may not cover the wire elements and can be formed by one or more layers of dielectric substrates. The wire elements 52 can be covered by the dielectric substrate layer 56. The lower dielectric substrate 54 can be formed by one or more layers 54*a,b,c* of dielectrics as shown in FIG. 3B. A filler material 58 is positioned between wire elements and can be formed by air gaps, adhesive film, or any other filling dielectric material.

Figure 4A:
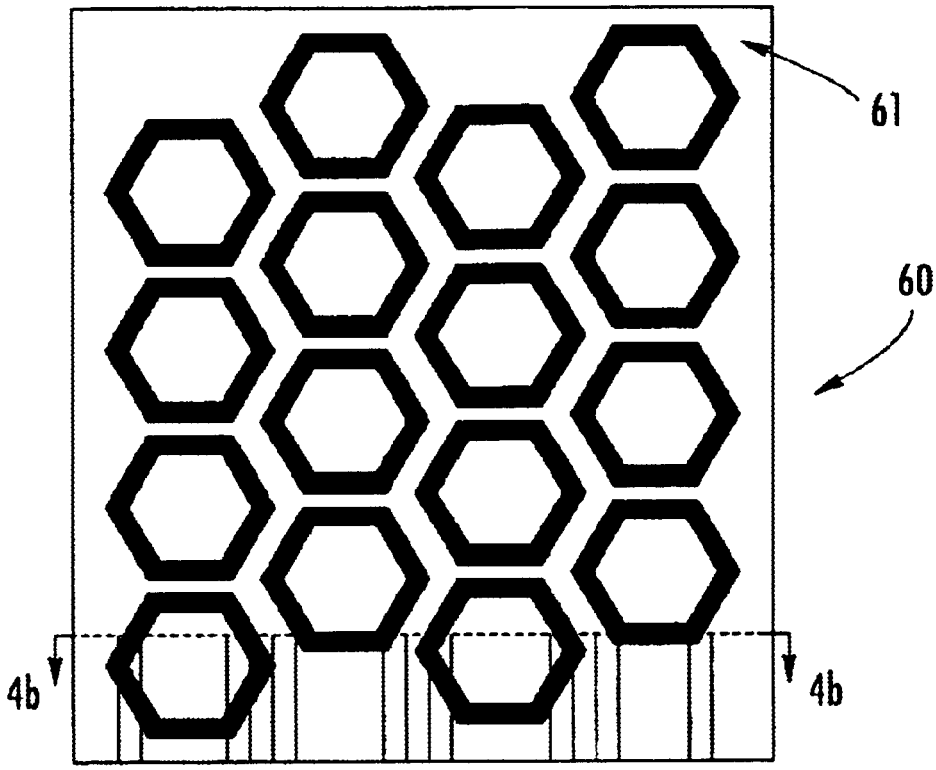
FIGS. 4A and 4B are views similar to FIGS. 3A and 3B, but showing a slot element formed by hexagonal slots in a metallic surface and showing the dielectric substrates.
Figure 4B:
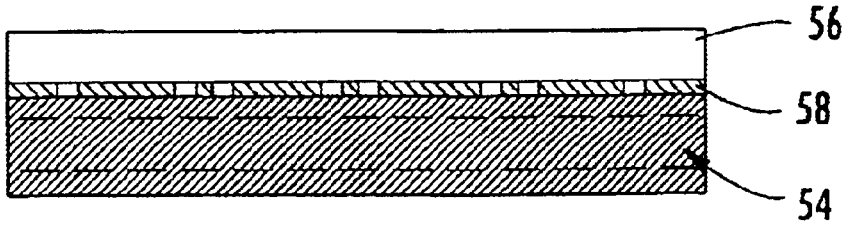

Another structure that is similar to that shown in FIGS. 3A and 3B is shown in FIGS. 4A and 4B and illustrates a hexagon slot element 60 formed by hexagon slots on a metallic surface 61, which could be placed on a similar dielectric surface 54 as used with the structure shown in FIGS. 3A and 3B. As in the previous embodiment, a dielectric substrate 56 may or may not cover any slot elements and, of course, can be formed by one or more layers of dielectric substrates. Slot elements can be covered by the one or more dielectric layers and the filler material 58 inside the slot elements can be air gaps, adhesive film, the substrate's dielectric, or any other filling dielectric material.

These elements and dielectric layers can be conveniently configured as a planar surface. However, they can also be configured as three dimensional non planar surfaces, or distributed in a three dimensional lattice. The placement of spatial filtering surface elements (devices) in a three-dimensional lattice differs from traditional frequency selective surface structures. As to the planar configured spatial filtering surface, they can be formed by one or more layers, separated by air or dielectric layers, as shown in FIGS. 5A, 5B and 5C.

FIG. 5A shows a one layer spatial filter surface 62, while FIG. 5B shows a two layer spatial filter surface 64 separated by an air gap 66. FIG. 5C shows a two layer spatial filter surface 68 separated by a dielectric layer 70 that is used to control the spatial filter surface transform tape function.

The characteristics of the spatial filtering surface taper transforms are determined by the resonance frequency of any spatial filtering surface elements, the spacing of the elements, the separation between dielectric or other layers, the dielectric constant of any dielectric layers, and the permeability of any dielectric layers. In addition, active devices, such as pin diodes, can be implanted in the spatial filtering surface elements to modify the element currents, and consequently the spatial transmission and reflection coefficients of the spatial filtering surface. Furthermore, the dielectric constant of the layers can be adjusted in some dielectric materials by using applied voltages.

Figure 7:
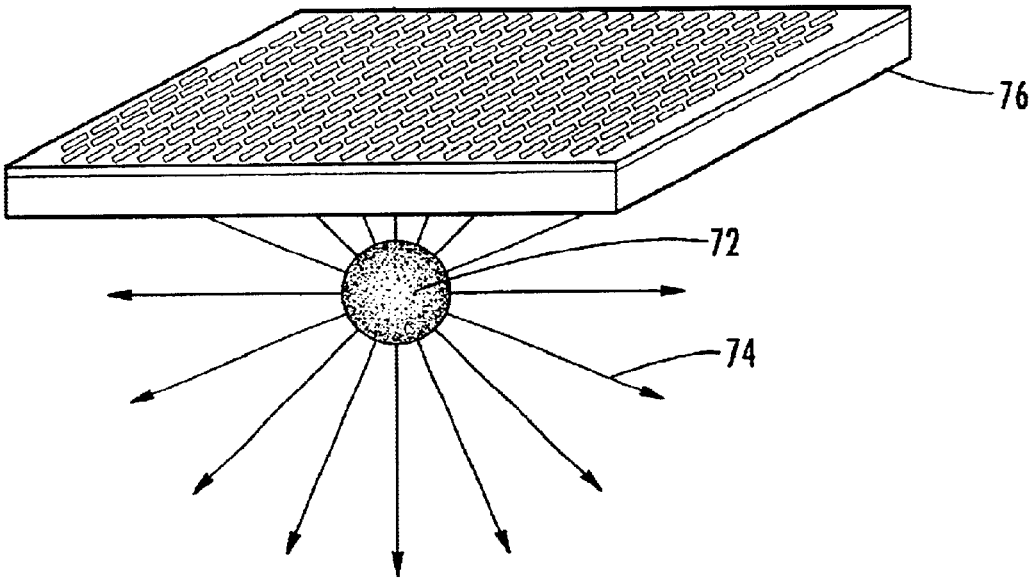
FIG. 7 is an isometric view of the radiating source shown in FIG. 6 where the radiation from the source is filtered spatially using the spatial filtering surface taper transform.
Figure 8:
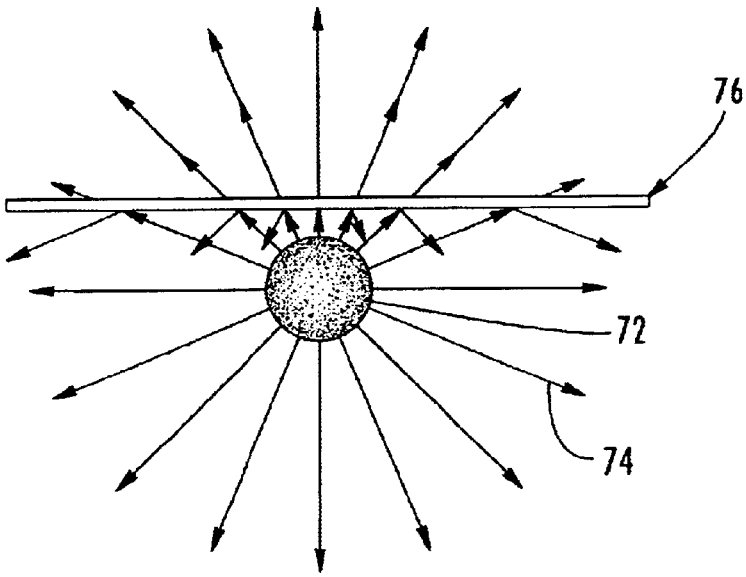
FIG. 8 is a fragmentary plan view of the radiating source shown in FIGS. 6 and 7, and shown with a spatial filtering surface, and showing how radial components of the pointing vector are filtered at different angles according to the taper transform of the spatial filtering surface.
Figure 9:
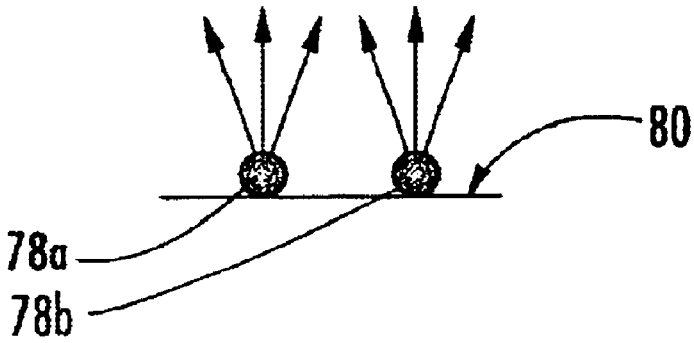
FIG. 9 is a fragmentary plan view showing a two element antenna array without a spatial filtering surface and formed by two radiating sources.
Figure 10:
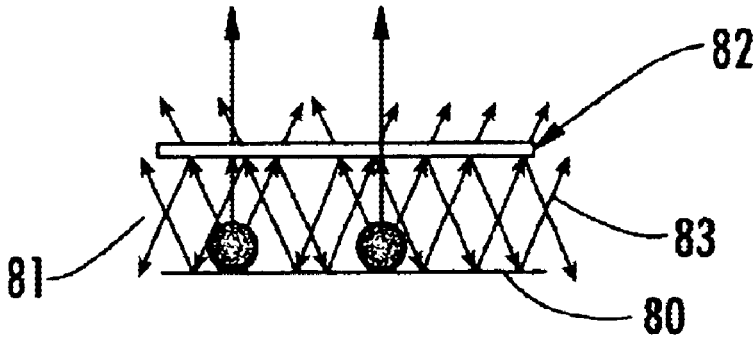
FIG. 10 is a fragmentary plan view similar to FIG. 9, but showing an example of the two element antenna array formed by two isotropic radiating sources, and showing a spatial filtering surface that filters out the pointing vector energy at some angles, but also creates a standing wave.

FIG. 6 illustrates an example of a radiating source 72, where the pointing vector energy 74 is in the radial direction. The same radiator in the presence of a spatial filtering surface 76 is shown in FIG. 7 where the radiation of the source is filtered spatially with the spatial filtering surface taper transform. A view of the transmitted and reflected pointing vector fields 74 in the radial direction at the spatial filtering surface, due to radiator 72, are shown in FIG. 8. The radiating source 72 with the spatial filtering surface 76 illustrates how the radial field components of the pointing vector are filtered at different angles according to the taper transform of the spatial filtering surface. All vector components of the fields are attenuated spatially as they are transmitted and reflected across the spatial filtering surface in the radial direction. FIG. 9 shows a two element array formed by two radiating sources 78*a,b* positioned at a ground plane 80. FIG. 10 shows the two element array in the presence of the spatial filtering surface 82. The reflected fields from the spatial filtering surface 82 create a standing wave 83 between the ground plane and the spatial filtering surface 82, which is attenuated through the free space defined by the air gap 81. When the standing wave adversely increase the antenna array sidelobe levels, the sidelobe levels are decreased using suitable techniques, such as the use of resistive materials for the ground plane 80, increasing the separation between the spatial filtering surface 82 and the ground plane 80, and other techniques known to those skilled in the art.

Figure 11:
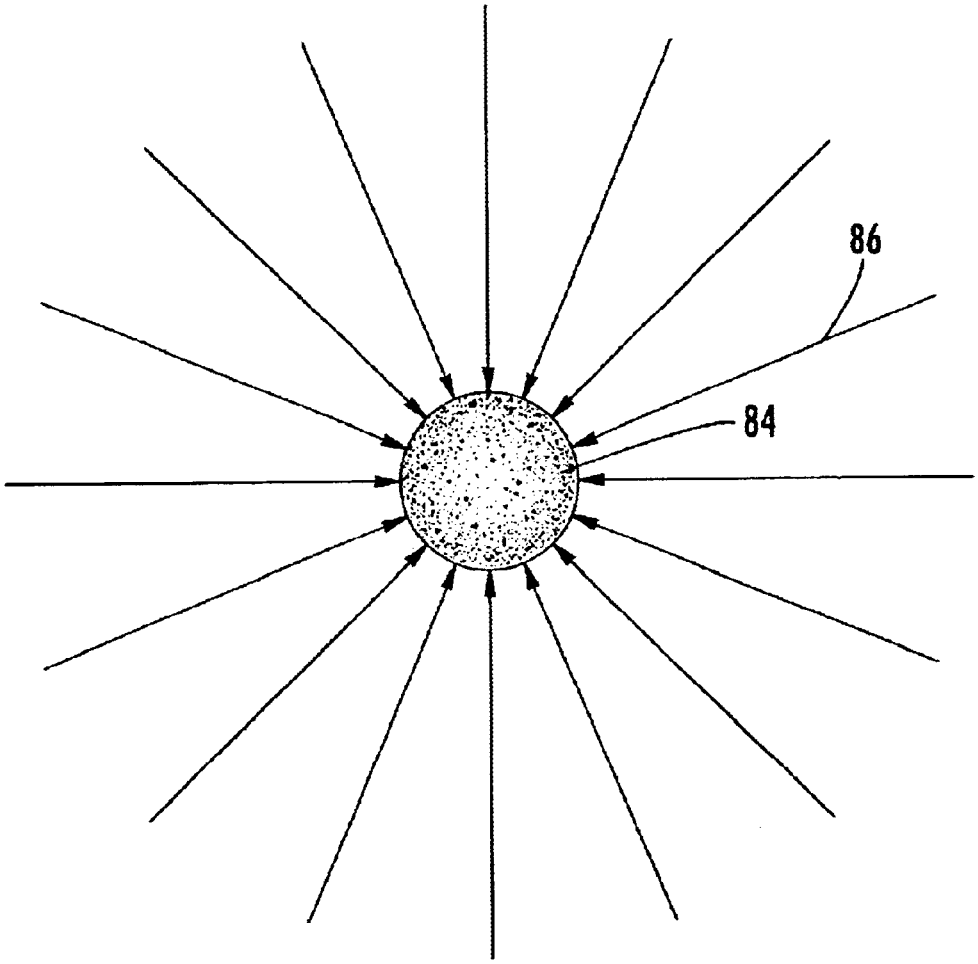
FIG. 11 is a fragmentary plan view of a receiving isotropic antenna element where the pointing vector is inward in the radial direction.
Figure 12:
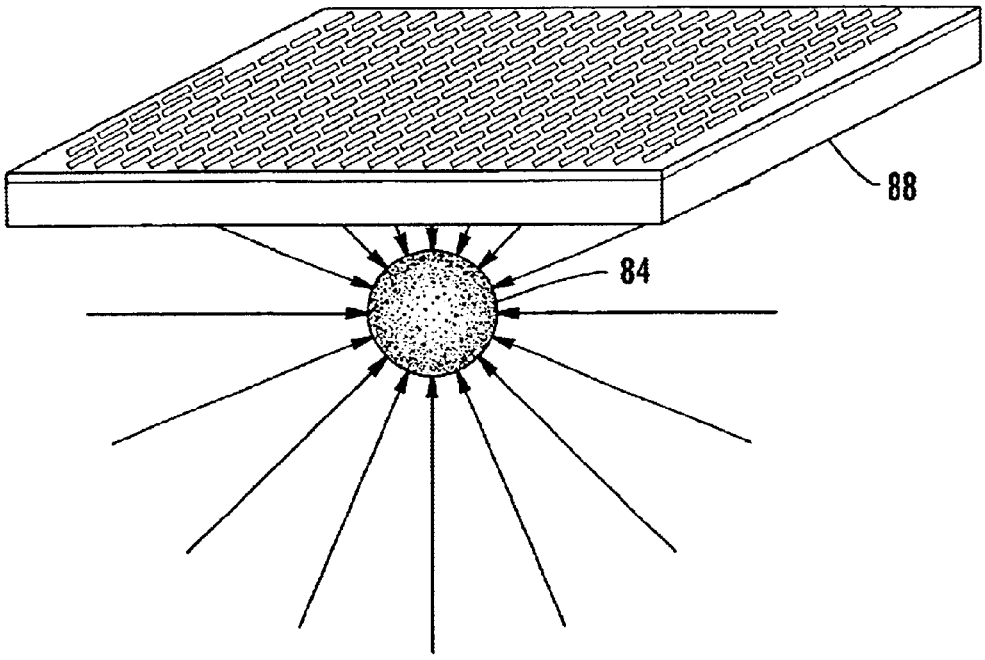
FIG. 12 is an isometric view of the isotropic antenna element shown in FIG. 11, where the radiation received by the antenna is filtered spatially using the spatial filtering surface taper transform.
Figure 13:
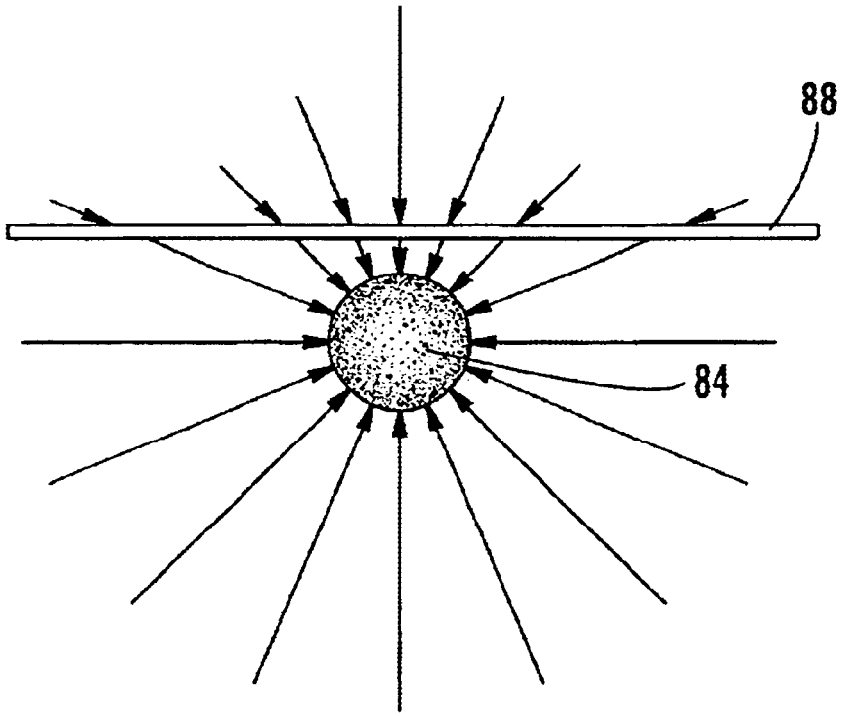
FIG. 13 is a fragmentary plan view similar to FIG. 12 and showing the receiving antenna element with a spatial filtering surface, and illustrating how radial components of the pointing vector are filtered at different angles according to the taper transform of the spatial filtering surface.
Figure 14:
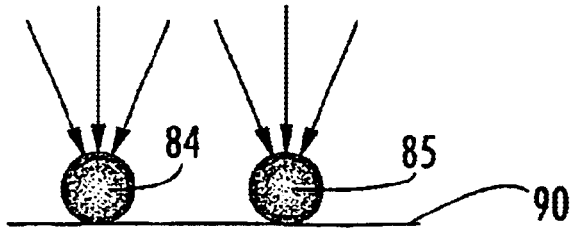
FIG. 14 is another fragmentary plan view of a two element receiving antenna array adjacent a ground plane and in use without a spatial filtering surface.
Figure 15:
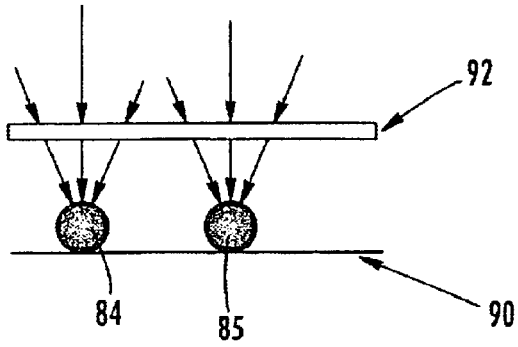
FIG. 15 is a fragmentary plan view similar to FIG. 14, but showing the two element antenna array with a spatial filtering surface that attenuates the oblique incident ray.

A large example of an isotropic receiving antenna element 84, as compared to the radiating source 72 (FIG. 6) is shown in FIG. 11, where the pointing vector energy 86 is in the radial direction, is shown in FIG. 11. The same receiving antenna element 84 in the presence of a spatial filtering surface 88 is shown in FIG. 12, where the radiation received by the antenna is filtered spatially with the spatial filtering surface transform function. A view of the transmitted and reflected Pointing vector in the radial direction for a spatial filtering surface 88 and a receiving antenna element 84 are shown in FIG. 12. All the vector components of the fields are attenuated spatially as they are transmitted and reflected across the spatial filtering surface. FIG. 14 shows a two element receiving array 84,85 on a ground plane 90 without a spatial filtering surface. FIG. 15 shows the two element 84,85 receiving array in the presence of the spatial filtering surface 92. In this example, the reflected fields from the spatial filtering surface 92 create an electromagnetic field formed of standing waves between the ground plane 90 and the spatial filtering surface 92, which is attenuated through the free space air gap. When the standing wave affects adversely the array sidelobe levels, the standing wave problem is solved using suitable techniques, such as the use of resistive materials for the ground plane 90, increasing the separation between the spatial filtering surface and the ground plane, and other techniques known to those skilled in the art.

Figure 16:
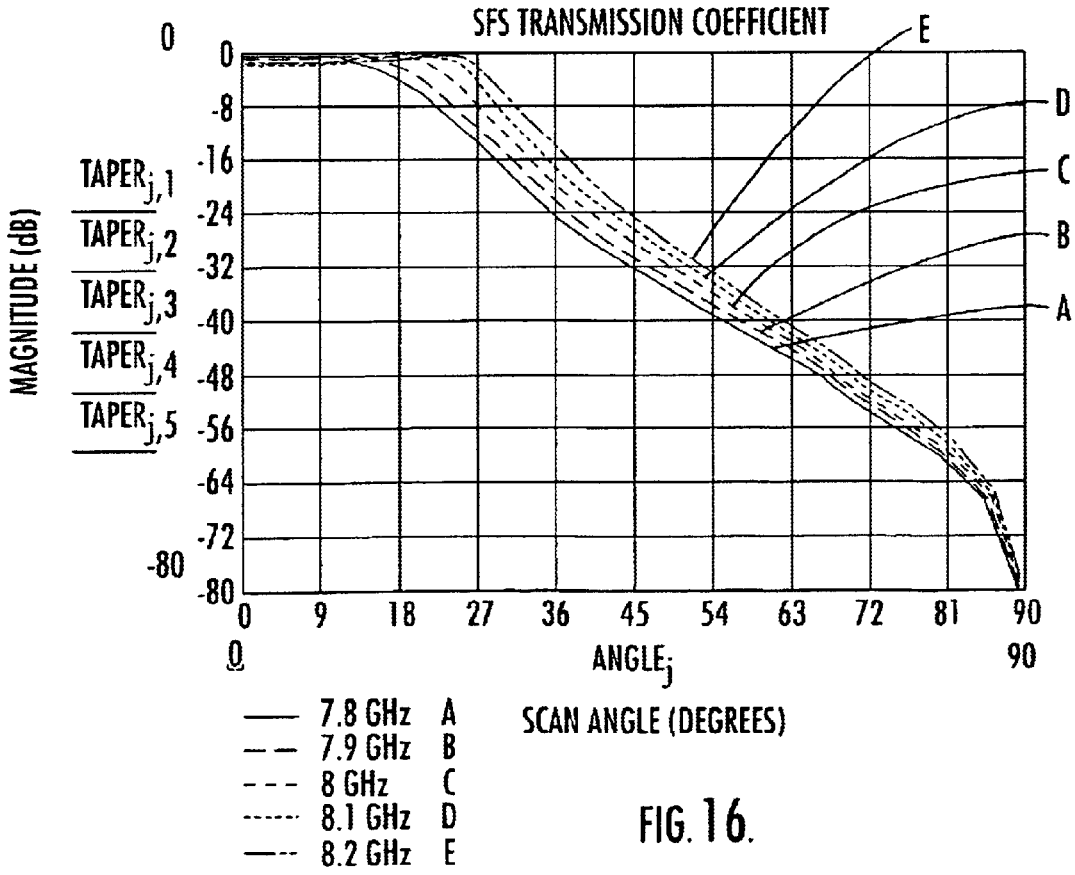
FIG. 16 is a graph illustrating an example of a spatial filtering surface taper showing a magnitude loss with scan angle θ and showing a different taper for 7.8, 7.9, 8.0, 8.1 and 8.2 GHz, and showing the scan angle in degrees along the x-axis, and the transmission coefficient magnitude in decibels along the y-axis.
Figure 17:
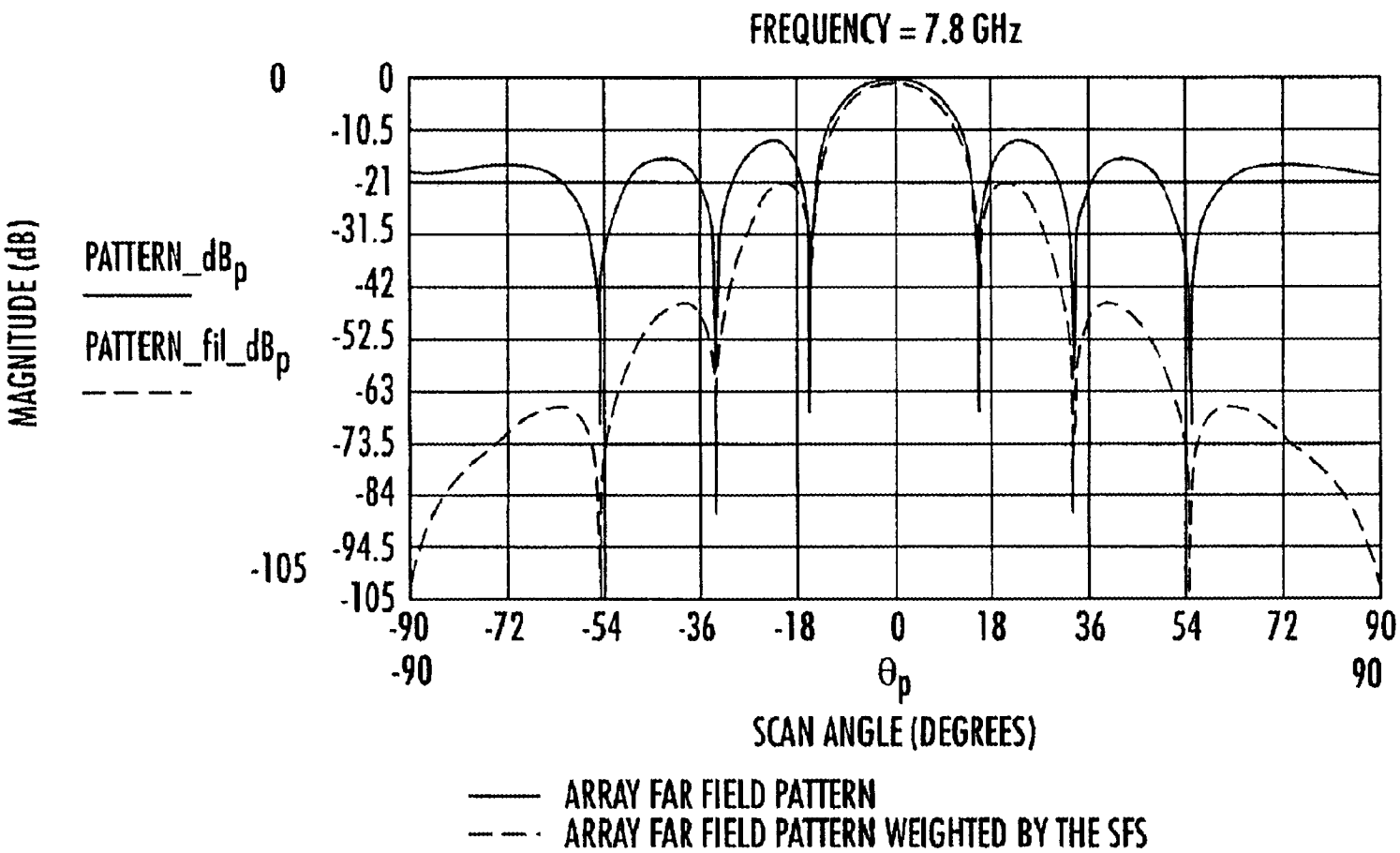
FIG. 17 is a graph showing the sidelobe reduction that can be achieved by enclosing a receiving 8-element linear array in a spatial filtering surface volume where the array element separation is one-half wavelength at 8.5 GHz and showing scan angle in degrees along the x-axis and the normalized antenna radiation pattern magnitude in decibels along the y-axis.
Figure 18:
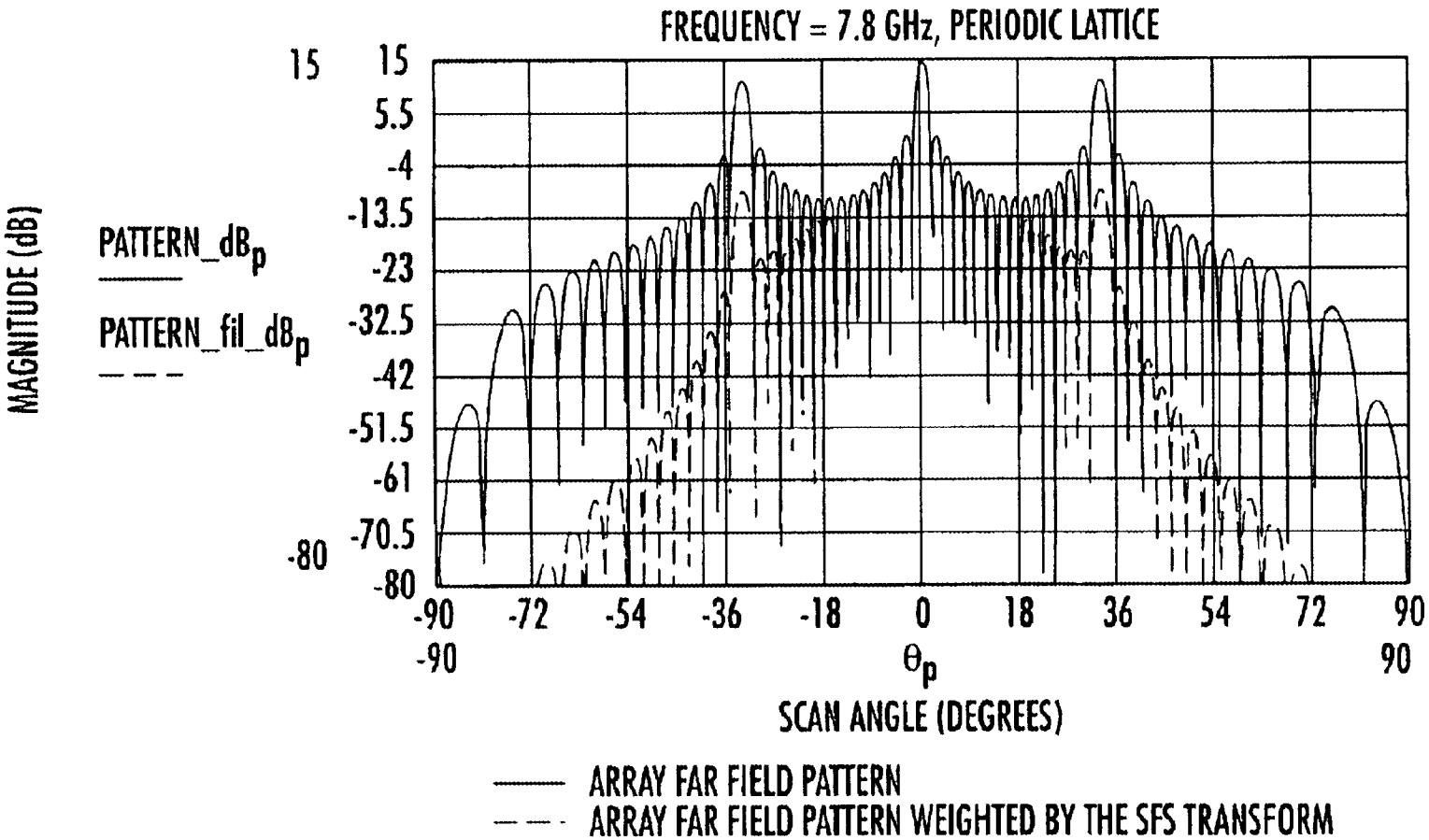
FIG. 18 is a graph illustrating a comparison of a 16-element antenna array pattern and the spatial filtering surface weighted receiving antenna array pattern at 7.8 GHz, and showing a reduction in sidelobe levels and grating lobes where the gain of the array is 14.308 dBi and the gain of the array with the spatial filtering surface is 14.417 dBi, resulting in a gain of 0.109 dB.

An example of a spatial filtering surface taper transform function is shown in the graph of FIG. 16. The transmission coefficient magnitude in decibels is related to the spatial scan angle and varies with frequency. A preliminary example showing the use of the spatial filtering surface taper transform for reducing the sidelobes of a receiving 8 element antenna array is presented in the graph of FIG. 17, which shows the original array far field radiation pattern compared with the array far field radiation pattern weighted by the spatial filtering surface. The sidelobe reduction is achieved by placing the spatial filtering surface on or around an 8 element receiving linear array, where the array antenna element separation is $\lambda/2$ at 8.5 GHz. FIG. 18 shows how the grating lobes of a receiving antenna array are reduced by the spatial filtering surface, causing also a small increase in the antenna gain. This data shown in both FIG. 17 and FIG. 18 are preliminary, and this analysis has neglected the interaction between the array and the spatial filtering surface.

In FIG. 18, the comparison of a 16 element antenna array radiation pattern and the radiation pattern of the array using the spatial filtering surface to weight the receiving antenna array pattern at 7.8 GHz shows a reduction in sidelobe levels and the grating lobes. The gain of the array is 14.308 dB, and the gain of the array with the spatial filtering surface is 14.417 dB, which resulted in a net gain of 0.109 dB. The spacing of the array elements is $2\lambda$ at 8.5 GHz (it is a periodic lattice).

It is also possible to use a spatial filtering surface device to increase the antenna aperture efficiency. This is accomplished by tapering the antenna aperture taper fields for circular apertures, reflectors, antenna arrays, or any other aperture antenna. An active spatial filtering surface for phased antenna arrays can also be used.

It is an established antenna design technique to change the antenna aperture fields in the antenna aperture to achieve desired far field radiation patterns characteristics. These radiation pattern characteristics goals are (a) increasing the gain of the antenna by increasing the aperture efficiency; (b) reducing the sidelobes; (c) achieving a specified sidelobe level taper; and achieving other goals as suggested by those skilled in the art. Traditionally, the antenna aperture fields are adjusted by performing physical and electrical changes on the antenna of interest. In the case of reflectors, the antenna optics can be optimized. Additionally, the reflectors can be shaped, and the feed horn antenna can be designed to meet a specific primary pattern field illumination criteria. In antenna arrays, the design parameters include the array lattice, the element pattern, the array size, and the complex weights of the elements.

The present invention provides an improved manner of adjusting the antenna aperture fields. It is known that the far field radiation pattern of an antenna aperture and the aperture fields are Fourier transform pairs. Therefore, any changes to the aperture fields will result in changes to its Fourier transform counterpart, which is the far field radiation pattern. For example, if the antenna physical and electrical characteristics remain unchanged, but the near electromagnetic fields of the aperture are tapered using an external device, such as a spatial filtering surface, then, the antenna far field characteristics, such as its efficiency and sidelobes, can be altered by using the spatial filtering surface at the antenna aperture. The spatial filtering surfaces can be applied to circular apertures, reflector antennas, antenna arrays, or any other aperture antenna.

For purposes of background, basic antenna aperture theory is set forth, and the application of spatial filters is illustrated using a circular aperture. The aperture fields of a Cassegrain reflector can be tapered with a spatial filtering surface device to increase the efficiency as will be explained in greater detail below. The near field of an antenna array is also tapered in order to produce a higher gain (higher efficiency), and scan the main beam. The use of a spatial filtering surface is approximately equivalent to changing the weights in an antenna array. Throughout this description, it should be understood that the resulting antenna gain in dBi is computed by integrating the computed far field radiation patterns.

It is well known to those skilled in the art that the maximum effective area $A_{em}$ of an antenna is related to the physical area A by the equation $A_{em}=\epsilon_{ap}A$, where $\epsilon_{ap}$ is the aperture efficiency, which is a number between zero and one, that is, $0 \leqq \epsilon_{ap} \leqq 1$.

The aperture efficiency is a figure of merit, which indicates how efficiently the physical area of the antenna is used. Aperture antennas typically have aperture efficiencies from about 30% to about 90%, horns from about 35% to about 80%, optimum gain horns about 50% efficiency, and circular reflectors from about 50% to about 80% efficiency.

The maximum directivity $D_0$ for an aperture antenna of physical area A, which corresponds to 100% efficiency or $\epsilon_{ap}=1$, is $$D_0 = \frac{4\pi}{\lambda^2}A.$$

However, the actual gain of the aperture antenna is limited by the efficiency $\epsilon_{ap}$, and it is given by $G=\epsilon_{ap}\cdot D_0$, i.e., the actual antenna gain is the directivity $D_0$ multiplied by the aperture efficiency $\epsilon_{ap}$.

When the far field radiation pattern of an antenna is known, the directivity can be computed using the equation:

$$D_0 = 4\pi \frac{F(\theta,\phi)|_{\max}}{\int_0^{2\pi}\int_0^{\pi} F(\theta,\phi)\sin\theta\, d\theta\, d\phi},$$

where $F(\theta,\phi)$ is the radiation intensity in Watts per unit of solid angle given by $F(\theta,\phi)=r^2\cdot W_{rad}$, and $W_{rad}$ is the radiation density in watts/meter2 given by the equation $$W_{rad} = \hat{r}\cdot\frac{1}{2}\mathrm{Re}(\overline{E}\times\overline{H}^*),$$

i.e., the radiation density is the radial component of one half the peak values of the cross product of electric field $\overline{E}$ by the complex conjugate of the magnetic field $\overline{H}$. $F(\theta,\phi)|_{max}$ is the maximum power number of the radiation intensity over all angles included in $\theta$ and $\phi$.

Figure 19:
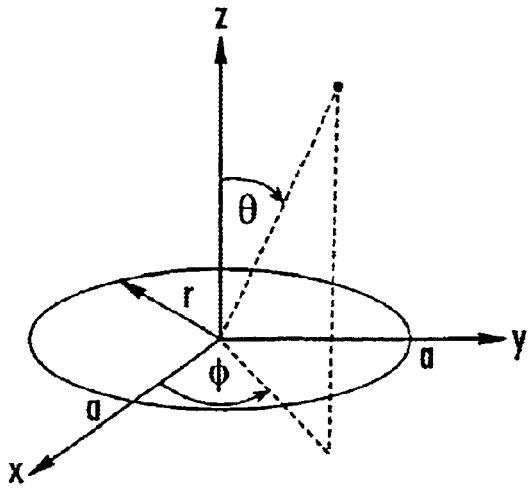
FIG. 19 is a graphical view of a circular source aperture for an antenna, placed in the spherical coordinate system.

The far field of an aperture and the aperture fields are Fourier transform pairs. The far field for a circular aperture, shown in FIG. 19 is $$T[u(\theta,\phi)] = \frac{2}{\pi^2}\int_0^{\pi} E_r(p)\cdot J_0[p\cdot u(\theta,\phi)]p\,dp, \text{ where } p = \frac{\pi r}{a},$$

$$u(\theta,\phi) = \frac{2\cdot a\cdot\sin\theta}{\lambda},$$

and $E_r(p)$ is the circular aperture electric field distribution.

A spatial filtering surface can be placed a close distance from the circular aperture so that the aperture electric field $E_r(p)$ distribution is modified. The equation above indicates that the far field can be changed with a spatial filtering surface. As noted before, the far field $T[u(\theta,\phi)]$ can be adjusted by multiplying the far fields of the antenna by the spatial filtering surface taper $E^{SFS}(\theta,\phi)$, i.e., new_far_field $(\theta,\phi)=E^{SFS}(\theta,\phi)\cdot T[u(\theta,\phi)]$. This application can be used only for a receiving antenna, where the received fields are filtered before they arrive at the antenna. For a transmitting or a receiving antenna, however, the spatial filter is used for shaping the aperture fields, which are the electric aperture field $E_r(p)$ in the equation above. When a spatial filtering surface device is used, the equation for the far field radiation pattern can be modified as follows, $$T[u(\theta,\phi)] = \frac{2}{\pi^2}\int_0^{\pi} E_r(p)\cdot E^{SFS}(\theta,\phi)\cdot J_0[p\cdot u(\theta,\phi)]p\,dp.$$

An antenna synthesis can be performed by first specifying the far field radiation pattern $T[u(\theta,\phi)]$ and then finding the aperture electric field distribution, which will produce the desired far field radiation pattern. Traditionally, the antenna geometry is changed to produce the desired aperture fields. With the usage of the spatial filtering surface of the present invention, however, the antenna can be left unchanged, and the spatial filtering surface can be used to alter the aperture electric fields, thus resulting in a simplified antenna design process.

Figure 20:
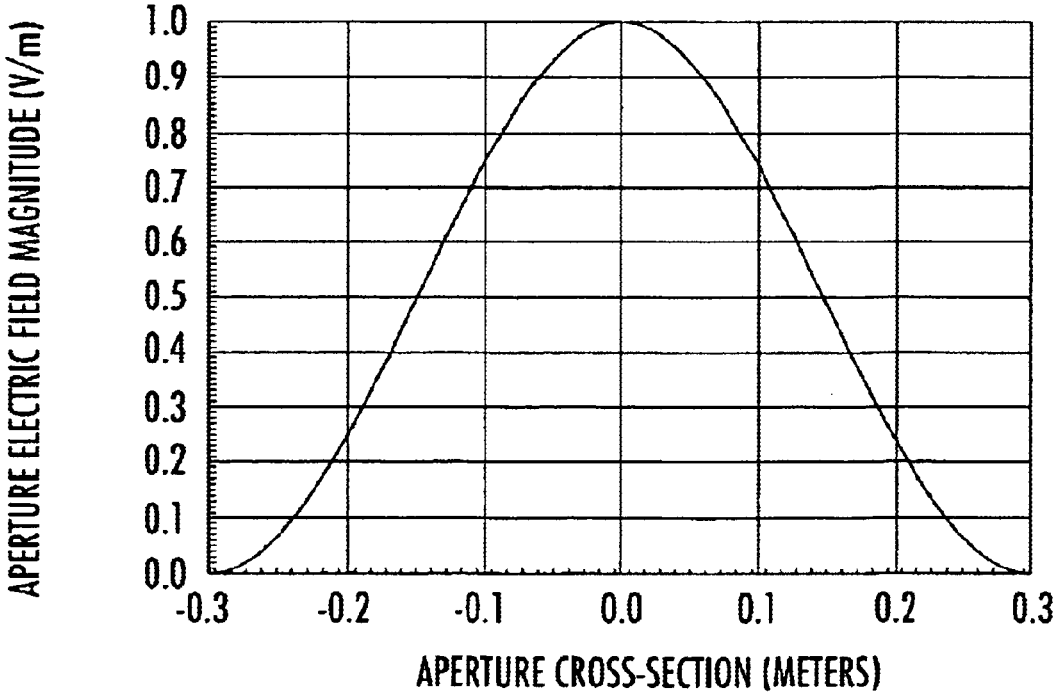
FIG. 20 is a graph illustrating an original circular antenna aperture field showing aperture cross-section in meters on the x-axis and the antenna aperture electric field magnitude on the y-axis.
Figure 21:
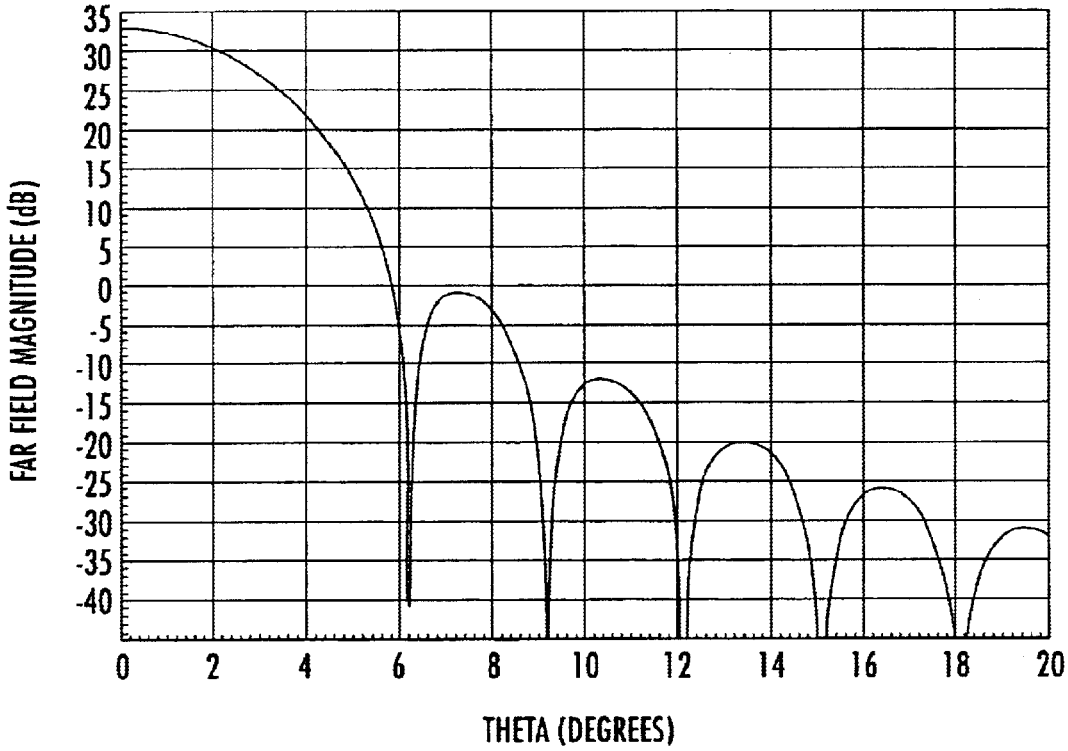
FIG. 21 is a graph showing the far field antenna radiation pattern produced with the original circular aperture field without the spatial filtering device of the present invention, and showing theta (degrees) on the x-axis and the antenna far field magnitude in decibels on the y-axis.

If the frequency is f=10 GHz, and the radius of the circular aperture is $a=10\cdot\lambda=0.3$ meters, the maximum achievable gain is set forth in the equation above, assuming 100 percent aperture efficiency, or $\epsilon_{ap}=1$, is $G_0=35.96$ dBi. If the circular aperture has aperture fields of the form $$E_r(p) = \cos^2\left(\frac{p}{2}\right) = \cos^2\left(\frac{\pi \cdot r}{2a}\right),$$

which are plotted in the graph of FIG. 20, the far field, computed using the equation above, is shown in the graph of FIG. 21, showing the original far field radiation pattern, produced with the original antenna circular aperture field, without the spatial filtering device. The computed gain is $G_1$=33.06 dBi, which corresponds to an aperture efficiency of $\epsilon_{ap}$=0.5125, or 51.25%.

Figure 22A:
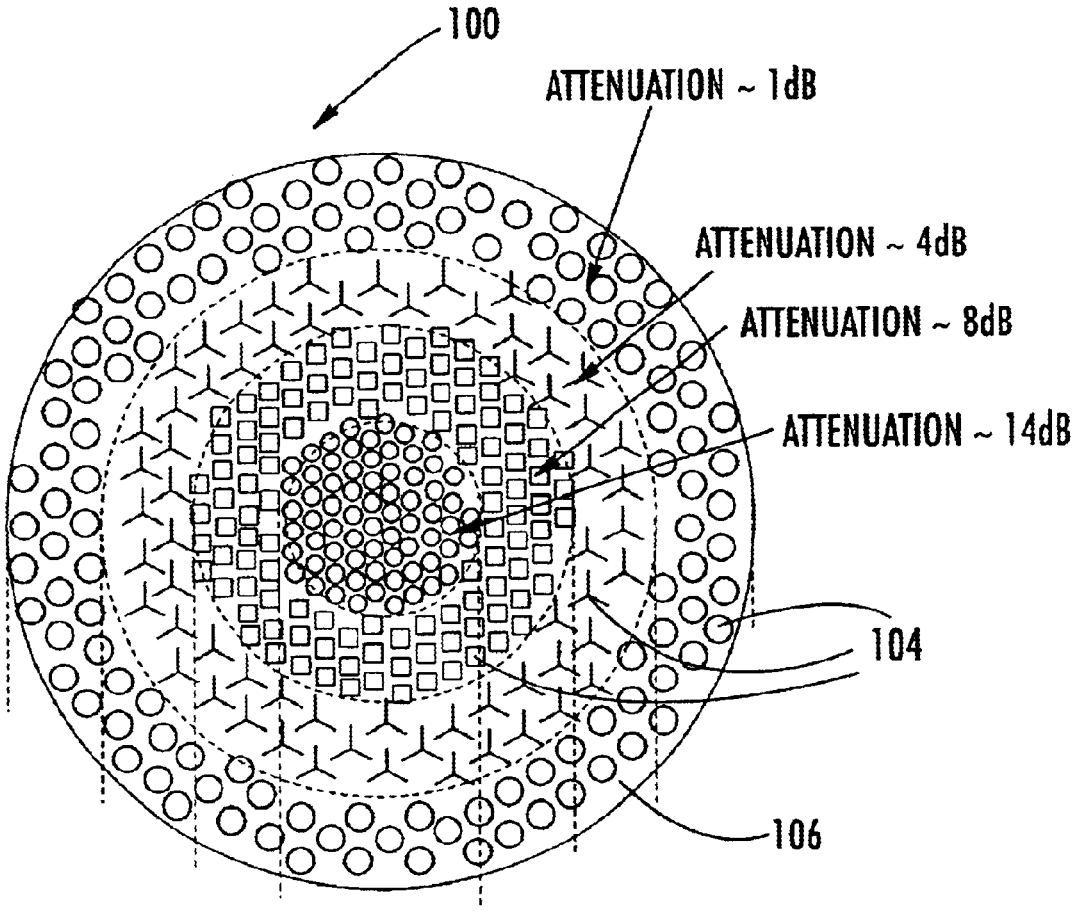
FIG. 22A is a top plan view of a spatial filtering surface used to modify the electric fields of a circular aperture and showing different elements in a lattice with the various signal transmission attenuations created by different elements with a different inter-element spacing.
Figure 22B:
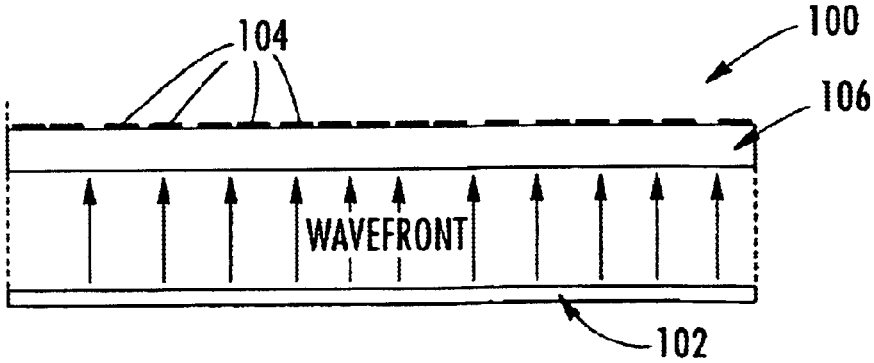
FIG. 22B is a sectional view of the spatial filtering surface of FIG. 22A and showing the dielectric layer, the spatial filtering surface elements, and the circular aperture.

Referring now to FIGS. 22A and 22B, a planar configured spatial filtering surface 100 is positioned above a circular aperture 102. Different rings or disks contain different wire or slot elements 104 as illustrated and create an artificial spatial filtering surface field aperture taper. The elements 104 are printed on a dielectric substrate 106, and can be made of metallic, resistive or dielectric materials, depending on the desired attenuation. In this case, the spatial filtering surface 100 tapers only the magnitude of the aperture field. The phase can also be tapered using different dielectric materials, with different thicknesses for each region. Phase tapers can also be achieved with stacks of non-resonant elements.

As illustrated in FIGS. 22A and 22B, the different elements 104 can have different inter-element spacings, and are also not limited to two dimensions, but could be placed in a three-dimensional lattice. These elements can be made of different materials as chosen by those skilled in the art, but typically are made of a resistive, metallic or dielectric material. The circular aperture 102 is shown in the side view with the wave front against the dielectric 106 and the elements 104. The different rings formed by the different elements have an attenuation of one decibel, four decibel, eight decibel and 14 decibels respectively.

Figure 23A:
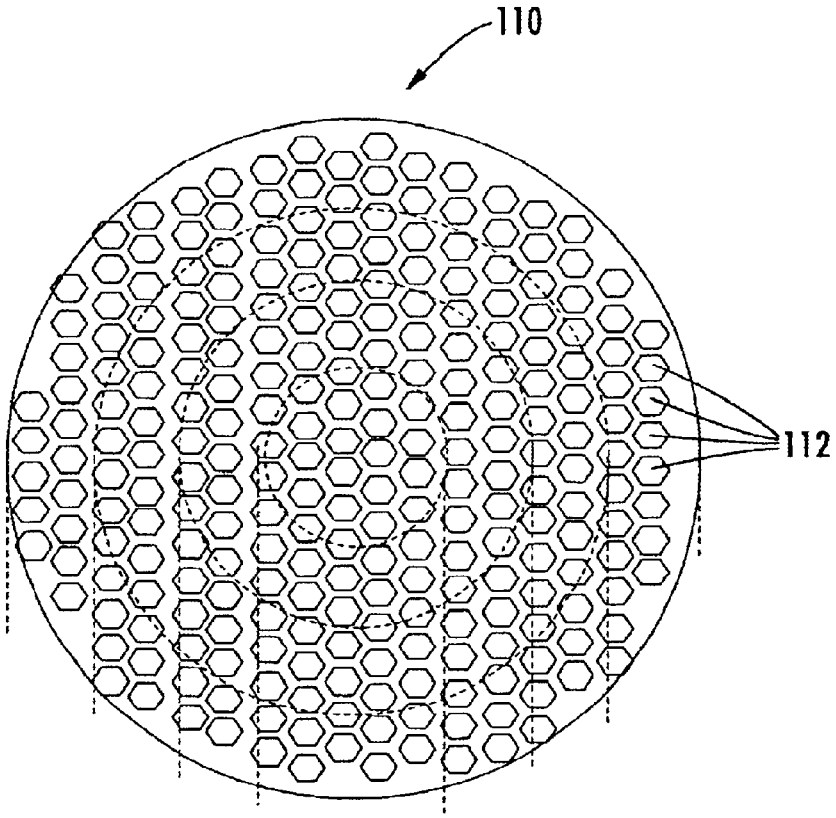
FIGS. 23A and 23B are respective top plan and side sectional views similar to FIGS. 22A and 22B, but showing a spatial filtering surface used to taper the electric fields of a circular aperture where the spatial filtering surface is non-planar and uses similar elements throughout the lattice.
Figure 23B:
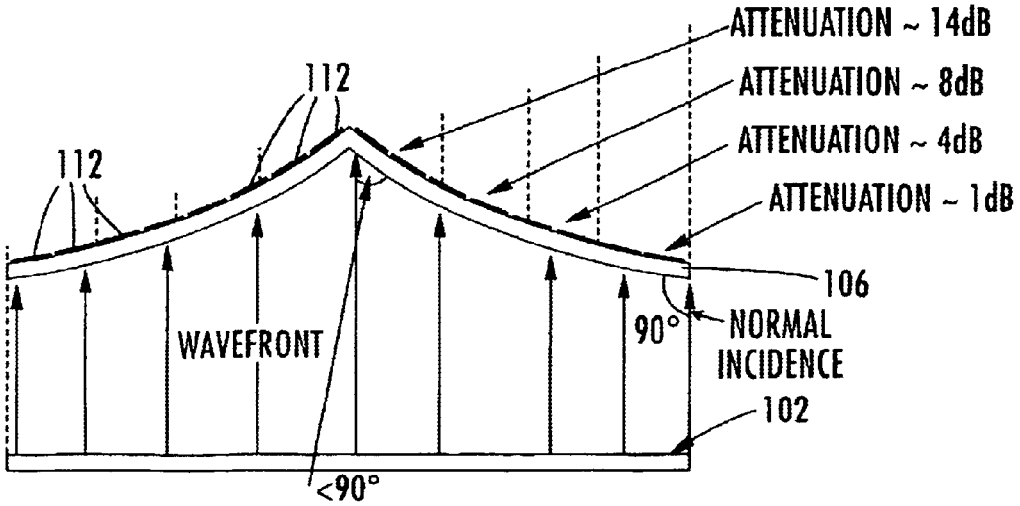

Another possible implementation of a spatial filtering surface 110 is shown in the non-planar configuration shown in FIGS. 23A and 23B. In this embodiment, instead of different types of elements as shown in FIGS. 22A and 22B, the same hexagonal element 112 is used in the entire spatial filtering surface 110. The spatial filtering surface 110 is curved, and the tapering mechanism relies on the principle that fields at different angles of incidence are attenuated differently. The spatial filtering surface 110 can also include slots having a surface made from a metallic or resistive material, and the elements formed over a dielectric. The choice of the spatial filtering surface architecture depends on the electrical requirements and existing fabrication processes.

Figure 24:
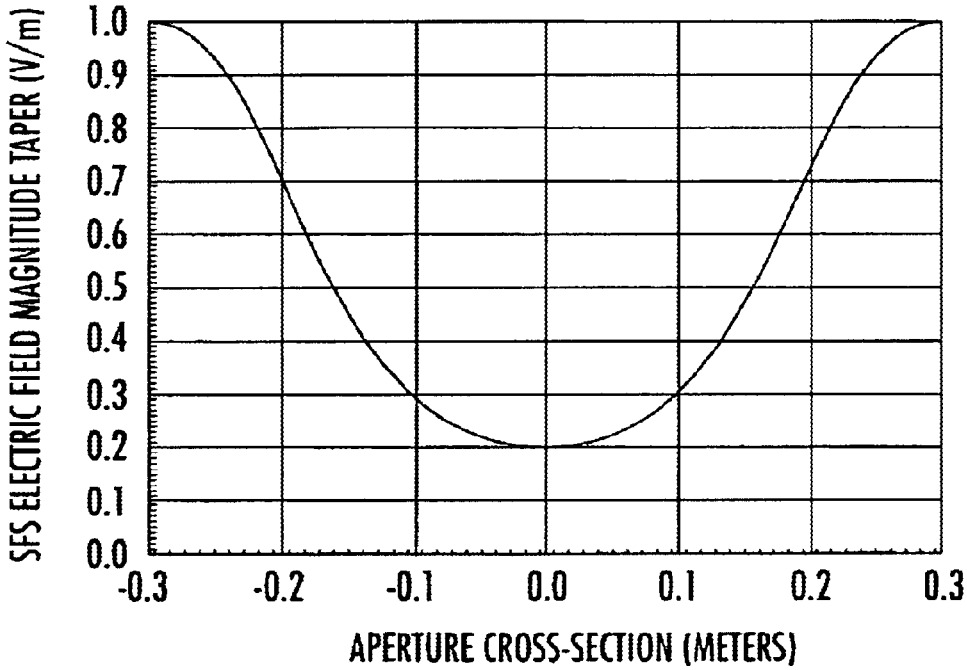
FIG. 24 is a graph showing the magnitude taper of the spatial filtering surface used for the circular aperture and showing the aperture cross-section in meters along the x-axis, and the spatial filtering surface electric field magnitude transmission taper on the y-axis.
Figure 25:
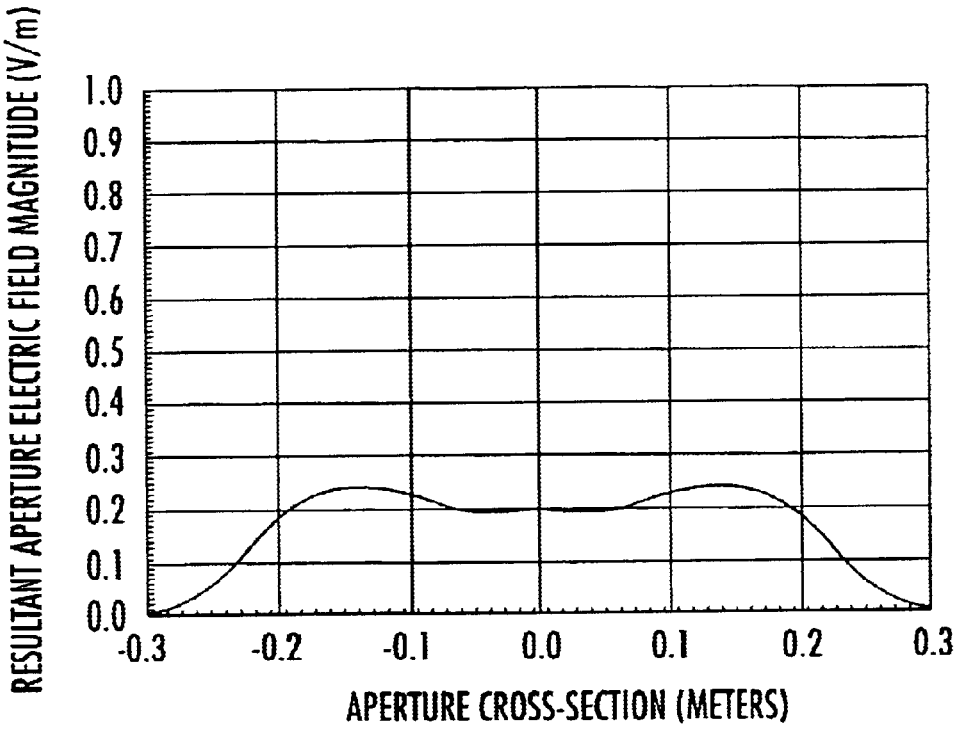
FIG. 25 is a graph showing the resultant antenna magnitude taper aperture fields after placing a spatial filtering surface device over the circular aperture.
Figure 26:
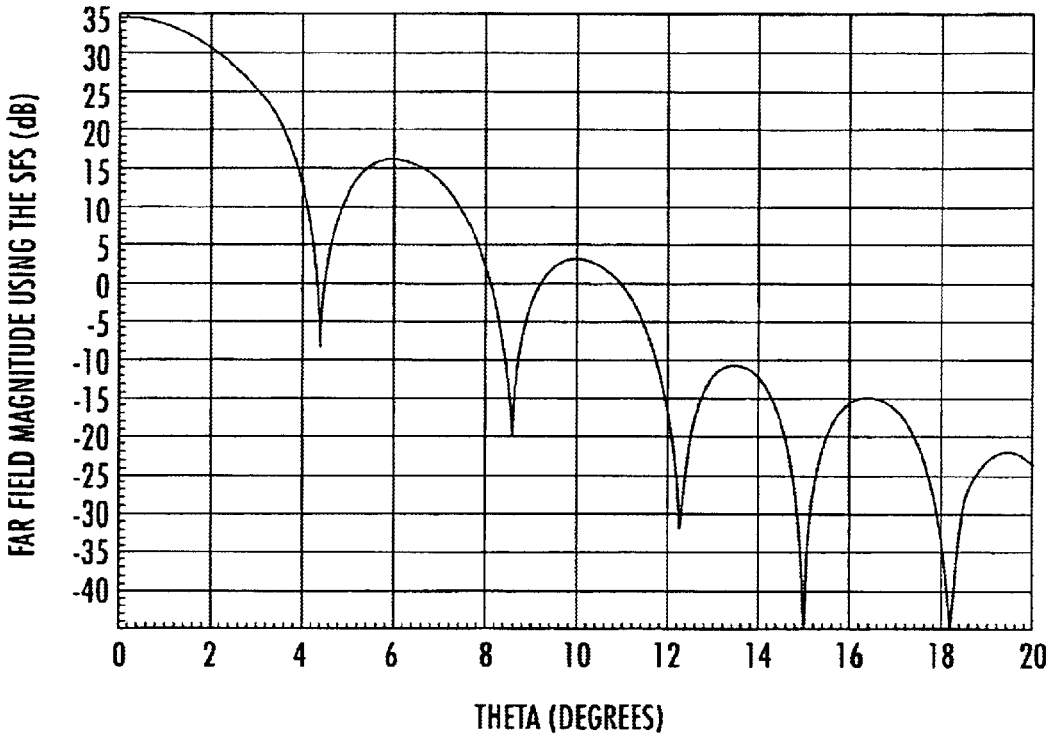
FIG. 26 is a graph showing the far field of the circular aperture after tapering the antenna aperture field magnitude with the spatial filtering surface device of the present invention.

The spatial filtering surface magnitude taper is shown in the graph of FIG. 24. The resultant aperture fields, after the spatial filtering surface is placed over the circular aperture, are shown in the graph of FIG. 25. The far field produced by this aperture field is shown in the graph of FIG. 26, where the gain is increased to 34.38 dBi, which corresponds to an aperture efficiency of 69.38%, or $\epsilon_{ap}$=0.6938.

Figure 27:
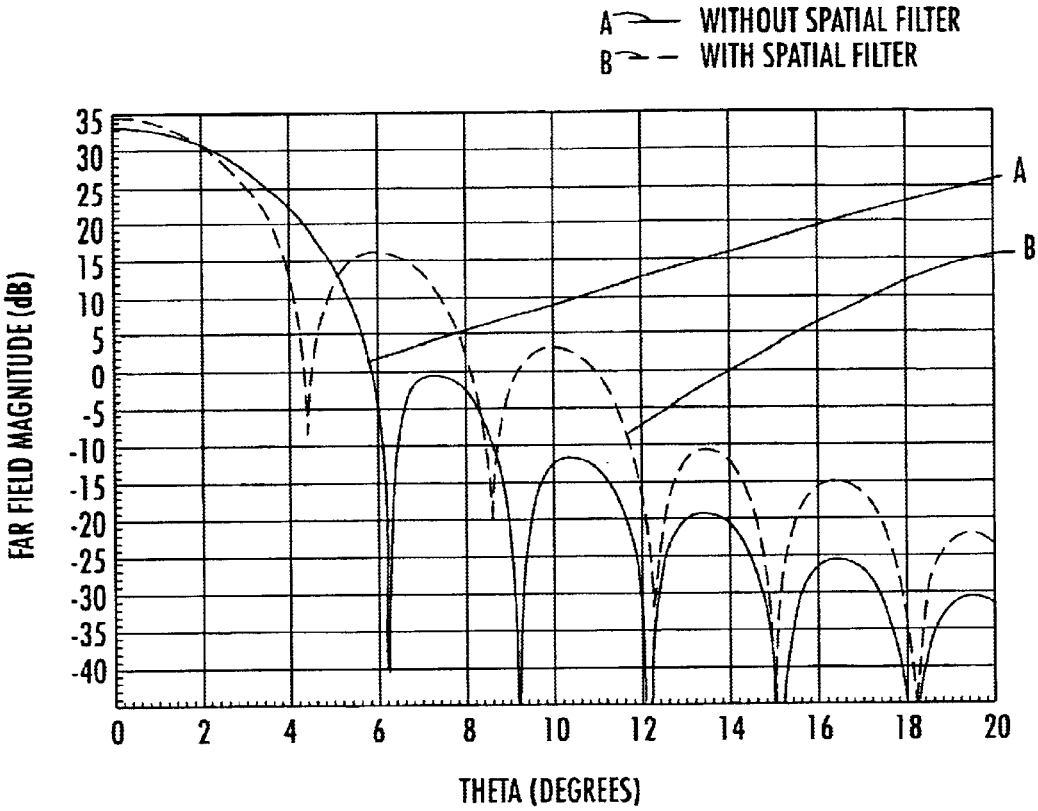
FIG. 27 is a graph showing a comparison of the far fields with and without the spatial filtering surface device of the present invention, and showing that the spatial filtering surface tapered the aperture magnetic fields in a manner such that the aperture efficiency increased. The sidelobes also increased.

This number corresponds to an 18.13% increase in the aperture efficiency. The comparison of the far fields with and without the spatial filtering surface is shown in the graph of FIG. 27, where it can be seen clearly that the efficiency increases when the spatial filtering surface is used. The tabulated gain and efficiency numbers are shown in Table I, showing the summary of the circular aperture gain with and without the spatial filtering surface, and the maximum theoretical gain.

TABLE I

Summary of the Circular Aperture Antenna Gain With and Without a Spatial Filter Surface

| CIRCULAR APERTURE CONFIGURATION | GAIN | EFFICIENCY |
|---|---|---|
| ORIGINAL APERTURE | 33.06 dBi | 51.25% |
| APERTURE WITH THE spatial filtering surface | 34.38 dBi | 69.38% |
| MAXIMUM THEORETICAL GAIN | 35.96 dBi | 100% |

It is also possible to use the spatial filtering surface of the present invention with reflector antennas. As is known to those skilled in the art, with reflector antennas, the aperture efficiency is a function of many factors, including spillover, amplitude taper, phase distribution, polarization uniformity, blockage, and surface errors. The efficiency of a prime focus reflector can be improved by optimizing the horn illumination, the optics of the antenna, the shaping of the main reflector, and other factors known to those skilled in the art. The efficiency can also be improved, however, by using the spatial filtering surface of the present invention.

The aperture field for a prime focus paraboloidal reflector is given by the electric field $$\overline{E} = E_o\hat{x}\left[B + (1-B)\left(1 - \frac{\rho^2}{a^2}\right)^p\right],$$

and the magnetic field $$\overline{H} = \frac{E_o}{\eta}\hat{y}\left[B + (1-B)\left(1 - \frac{\rho^2}{a^2}\right)^p\right],$$

where "a" is the radius of the circular reflector aperture, "ρ" is the radial aperture coordinate, given by: $\rho=\sqrt{x^2+y^2}$, "p" is a parameter which can be 0, 1, 2, etc, B is the edge taper of this axially symmetric polynomial on a pedestal distribution and "η" is the intrinsic impedance of free space given by: $\eta=120\pi\Omega\approx376.99\Omega$.

The far field is given by the equation, $$E(\theta) = B \cdot \frac{J_1(ka\cdot\sin\theta)}{ka\cdot\sin\theta} + \left[\frac{1-B}{2(p+1)}\right]\cdot\left[2^{p+1}\cdot(p+1)!\cdot\frac{J_{p+1}(ka\cdot\sin\theta)}{(ka\cdot\sin\theta)^{p+1}}\right],$$

where $$k = \frac{2\pi}{\lambda},$$

"λ" is the wavelength, given by $$\lambda = \frac{c}{f},$$

"c" is the speed of light, "f" is the frequency, "$J_1(ka\cdot\sin\theta)$" is the Bessel function of order one and "$J_{p+1}(ka\cdot\sin\theta)$" is the Bessel function of order (p+1).

Figure 28:
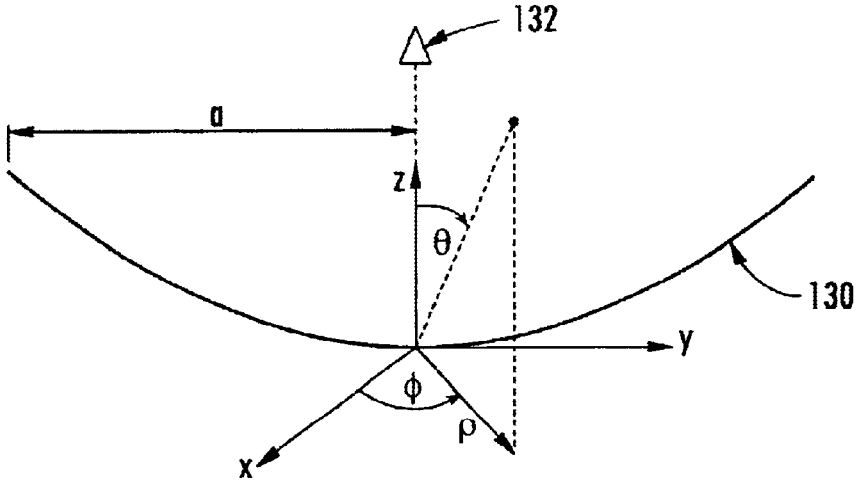
FIG. 28 is a fragmentary drawing view of the geometry for a paraboloidal reflector antenna that can be used with the spatial filtering surface of the present invention.

A fragmentary drawing of a prime-focus paraboloidal reflector 130 is shown in FIG. 28, showing the main reflector in side elevation relative to the feed horn 132. The radius of the reflector in this example is a=10λ. At a frequency of 10

GHz, λ=0.03 m, a=0.3 m. In addition, when p=2, and the edge taper is −30 dB, this gives $$B = 10^{\frac{-30}{20}} = 0.0316228.$$

Figure 29:
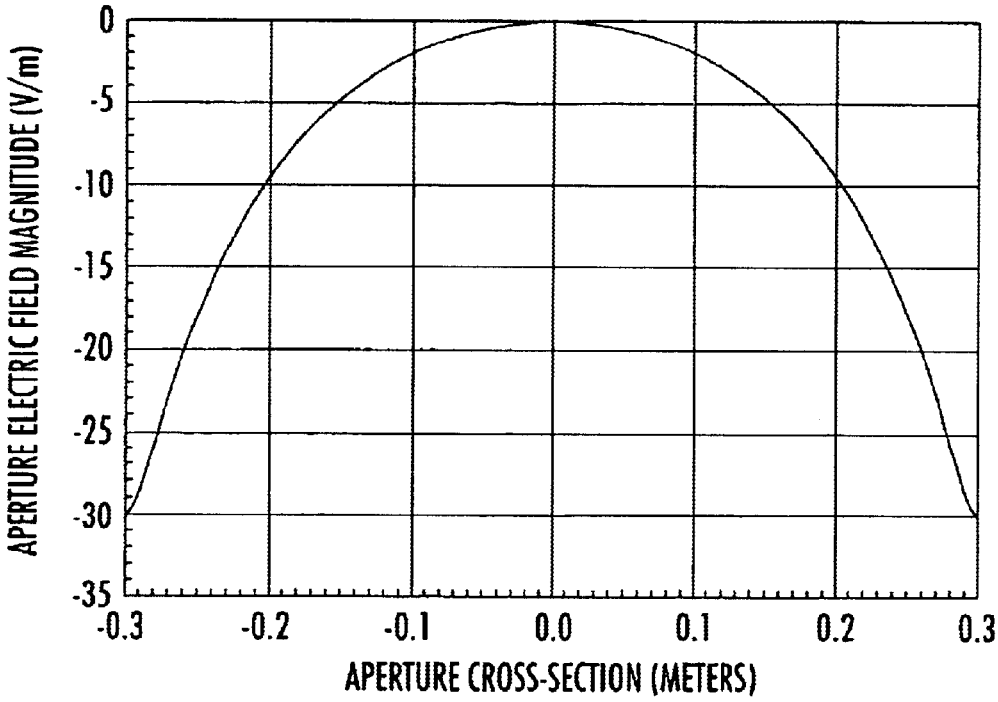
FIG. 29 is a graph showing a reflector antenna original aperture field and showing the aperture cross-section in meters on the x-axis and the aperture electric field magnitude on the y-axis.
Figure 30:
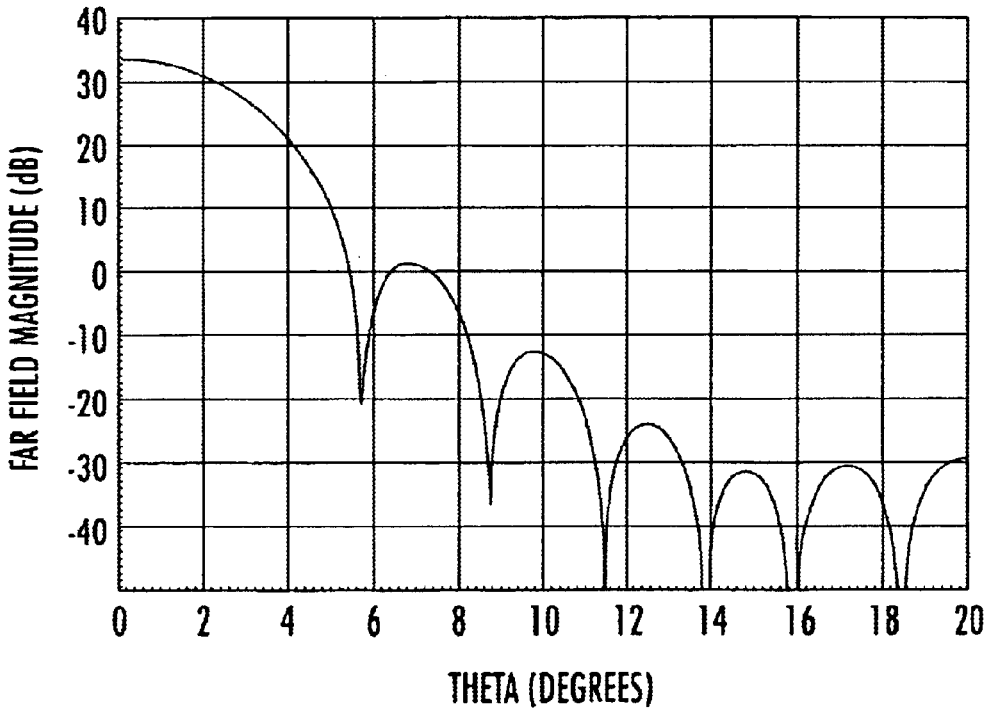
FIG. 30 is a graph showing the original reflector antenna far field radiation pattern showing the angle theta on the x-axis and the far field magnitude in dBi on the y-axis.
Figure 31A:
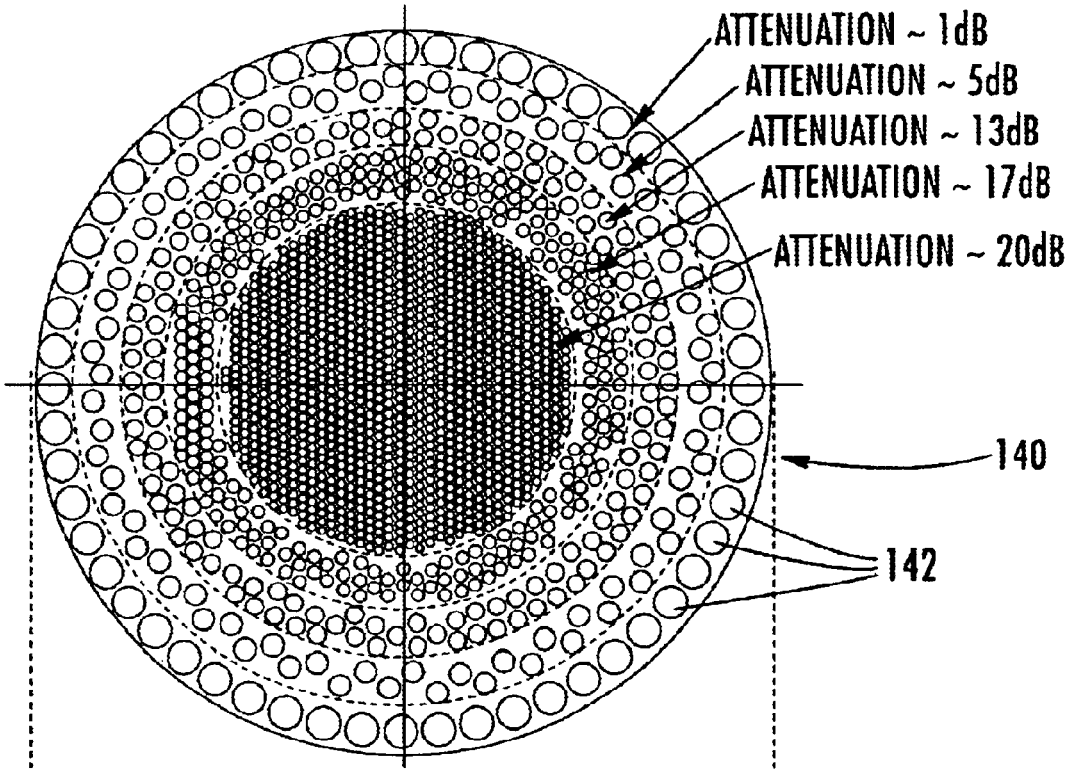
FIG. 31A is a top plan view of a planar configured spatial filtering surface device where different sizes of the same circular ring element are shown on the spatial filtering surface and the lattice spacing from element to element is changed.
Figure 31B:
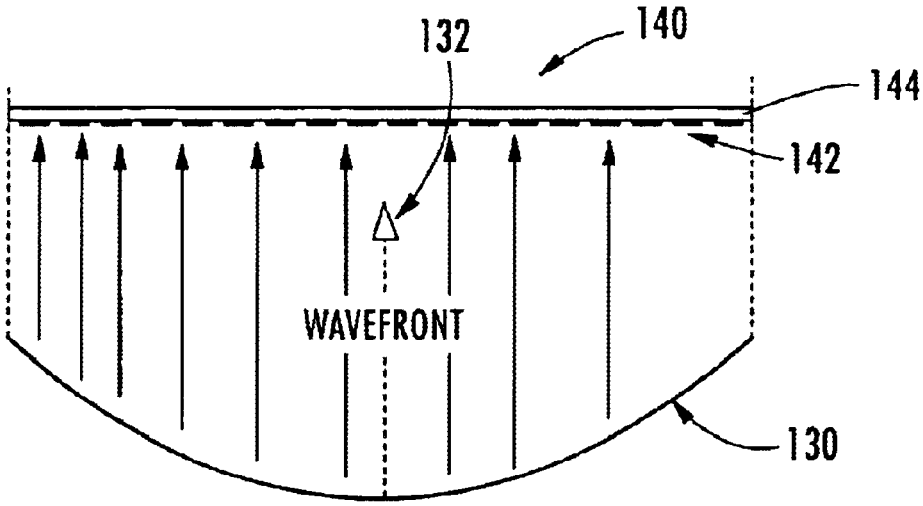
FIG. 31B is a sectional view of the planar configured spatial filtering surface device over a prime focus reflector antenna and showing the main reflector and the spatial filtering surface elements as circular ring wires or slots placed on a dielectric and positioned to receive the wave front from the main reflector.

The original aperture fields for this antenna configuration are shown in the graph of FIG. 29. The far field for this reflector is shown in the graph of FIG. 30, where the gain is 33.68 dBi, which corresponds to an efficiency of 59.16%. Two possible configurations for a spatial filtering surface are shown in FIGS. 31A, 31B, 32A and 32B. As shown in FIGS. 31A and 31B, the planar configured spatial filtering surface 140 is formed of different elements 142 made from wires of metallic or resistive material, or slots, printed on metallic or resistive materials, on a dielectric 144. The front plan view shows in FIG. 31A the various elements 142 positioned in different rings, resulting in an attenuation of one decibel at the outer ring with progressive attenuation of five decibels, 13 decibels, 17 decibels and 20 decibels respectively for the inner rings. This prime focus reflector antenna 130 with the planar configured spatial filtering surface 140 includes different sizes of the hexagonal elements in circular rings. In the spatial filtering surface, the circular disks and the spacing from element-to-element vary.

Figure 32A:
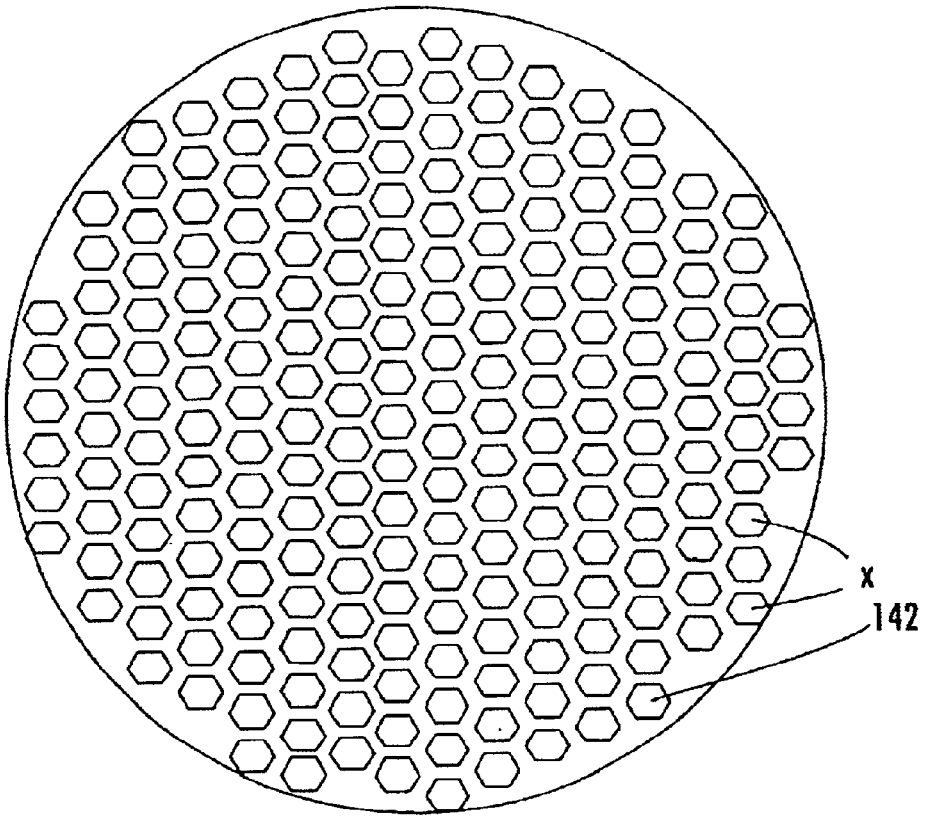
FIGS. 32A and 32B are views similar to FIGS. 31A and 31B, but showing a prime focus reflector antenna and a curved spatial filtering surface where the same hexagonal element wires or slots are used and the surface curvature of the spatial filter is adjusted to meet the specified aperture field taper.
Figure 32B:
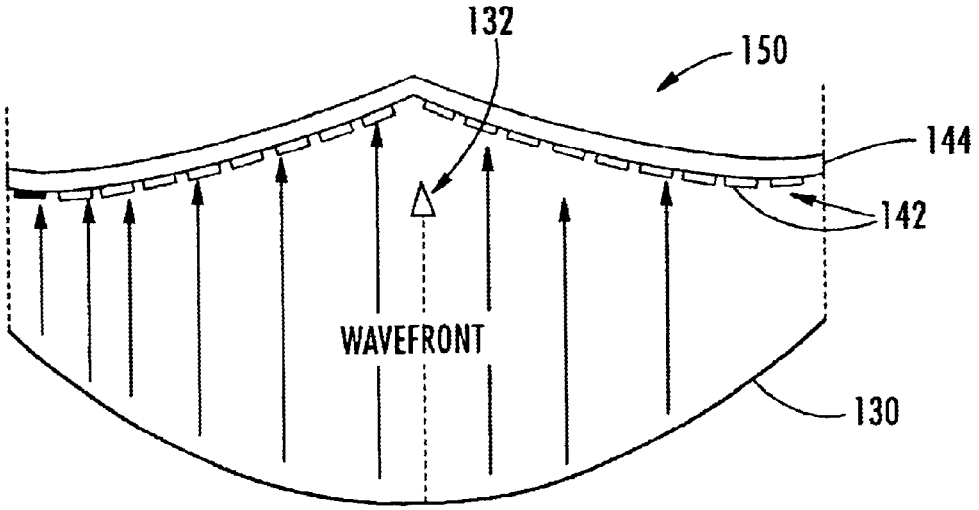

FIGS. 32A and 32B illustrates a different embodiment of a curved spatial filtering surface showing a view of the prime focus reflector antenna 130 with a curved spatial filtering surface 150. Similar sized hexagonal elements are used, and the surface curvature of the spatial filtering surface is adjusted to meet the specified aperture field taper. The spatial filtering surface elements can be formed from metallic or resistive material or formed as slot elements.

Figure 33:
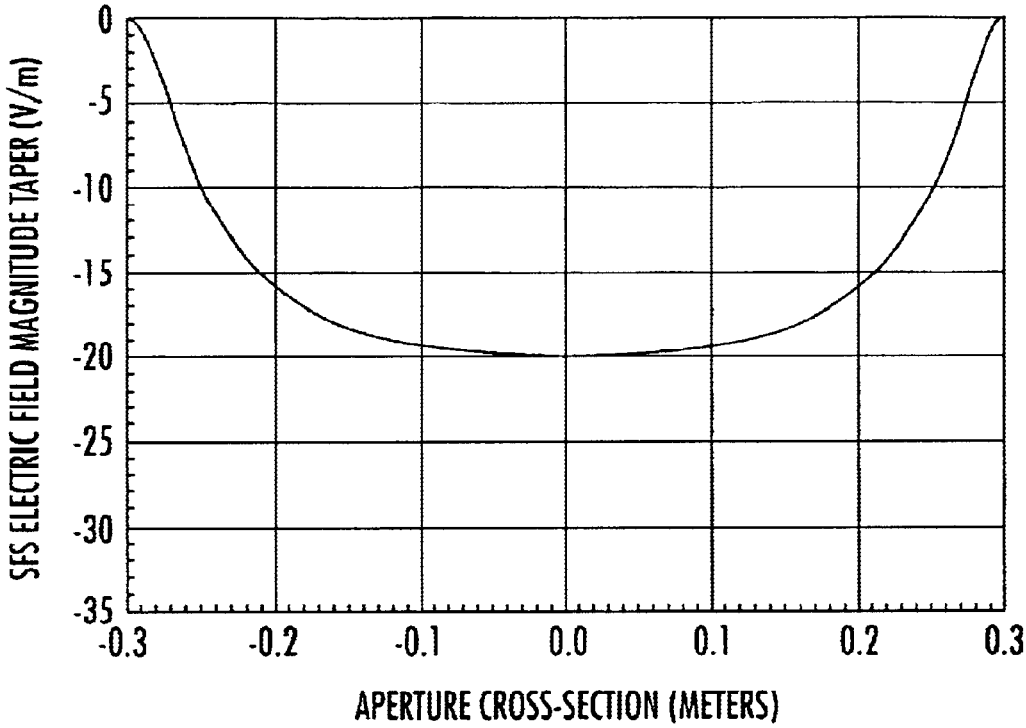
FIG. 33 is a graph showing the spatial filtering surface device taper that is applied to the aperture fields of the prime focus paraboloidal reflector.
Figure 34:
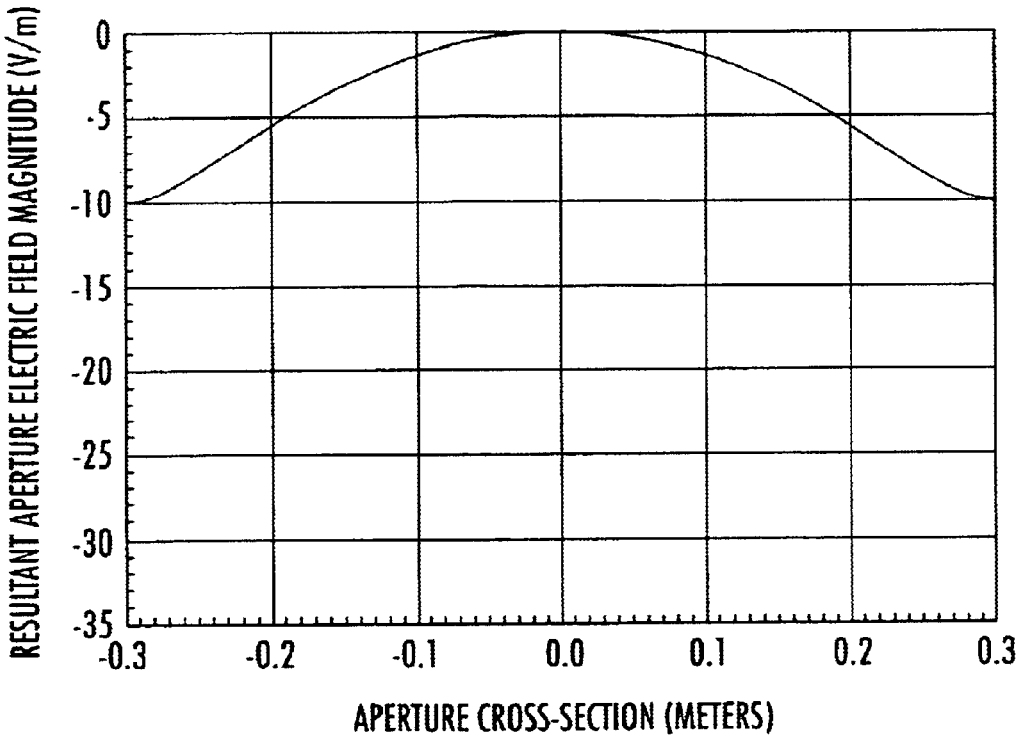
FIG. 34 is a graph showing the resultant reflector aperture taper using the spatial filtering surface device of the present invention, and showing the aperture linear cross-section in meters on the x-axis, and the resultant aperture electric field magnitude on the y-axis.
Figure 35:
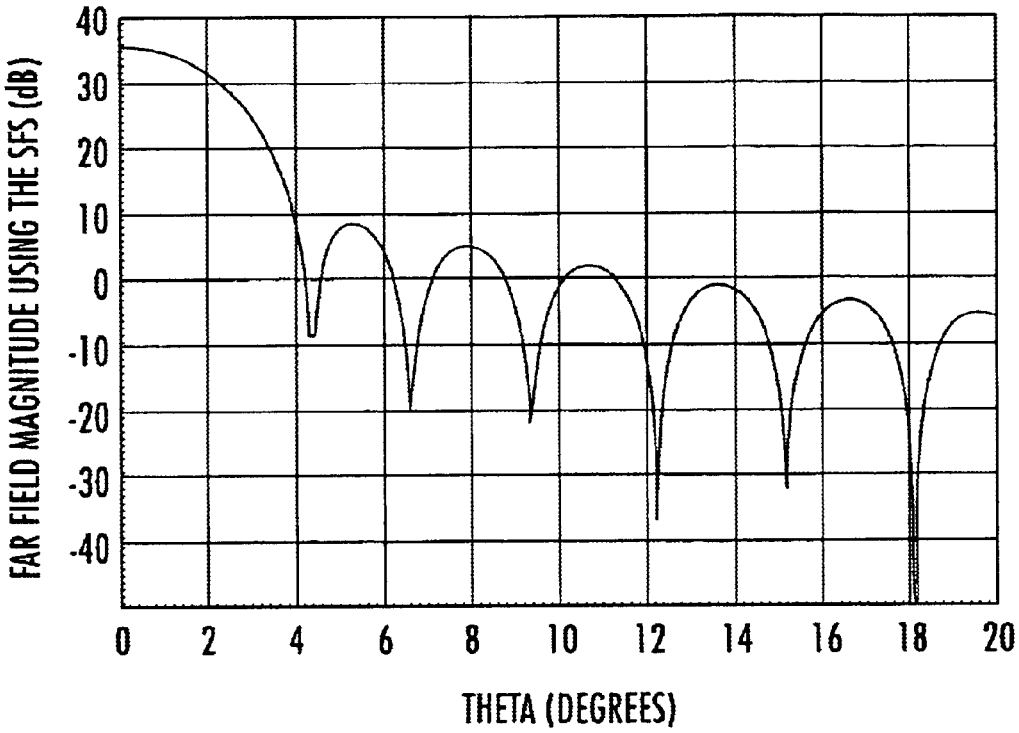
FIG. 35 is a graph showing the far field of the prime focus paraboloidal reflector aperture after the aperture fields have been modified with the spatial filtering surface of the present invention and showing theta (in degrees) on the x-axis, and the far field magnitude on the y-axis.
Figure 36:
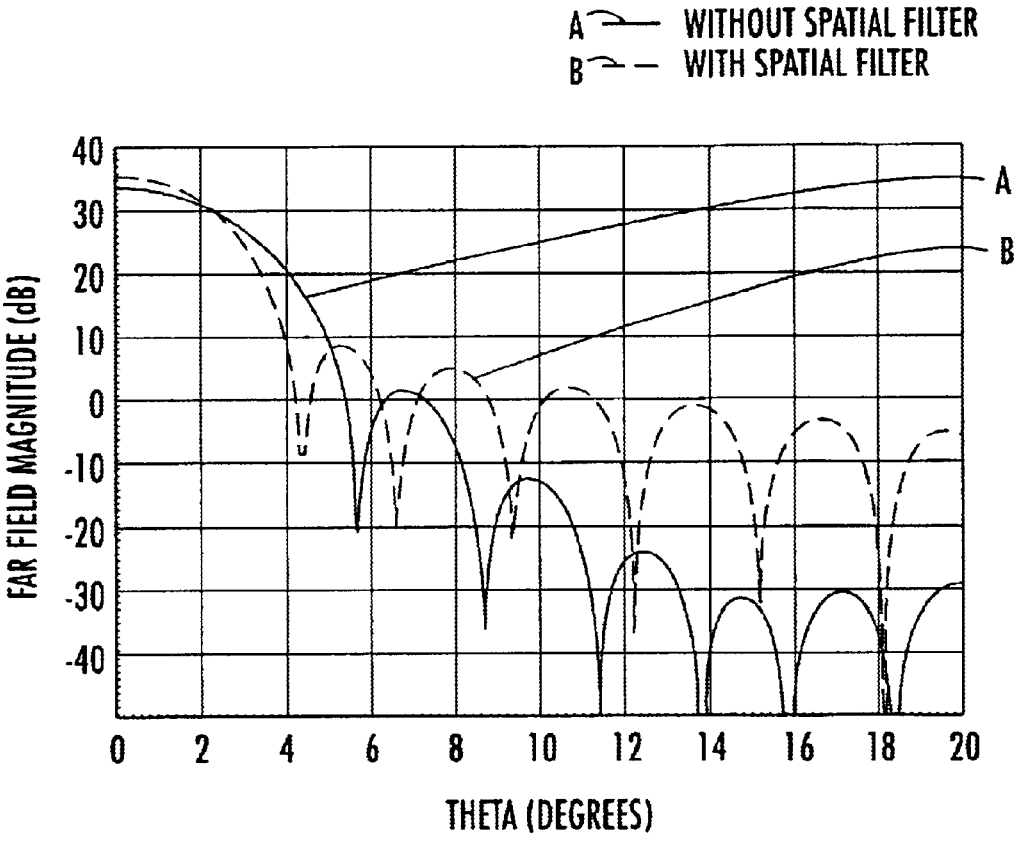
FIG. 36 is a graph showing a comparison of the reflector far field with and without the spatial filtering surface, where the spatial filtering surface has altered the aperture fields such that the aperture efficiency and the sidelobes have increased.

The taper that is used for the spatial filtering surface is shown in the graph of FIG. 33. The resultant reflector aperture taper, when the spatial filtering surface device is used, is shown in the graph of FIG. 34. The far field corresponding to the reflector with the spatial filtering surface is shown in FIG. 35, where the gain increased to 35.36 dBi, which corresponds to an aperture efficiency of 87%. A comparison of the far field with and without the spatial filtering surface is shown in FIG. 36, where the usage of the spatial filtering surface device increased the gain by 1.68 dB, which corresponds to an aperture efficiency increase of 27.84%. Although the efficiency of the antenna increased, there was some power loss associated with the use of the spatial filtering surface, which must be taken into account during the antenna design.

In this example, only the magnitude of the aperture field was adjusted. The tabulated gain and efficiency numbers are shown in Table II. Spatial filtering surfaces not only can be used with prime focus reflector antennas, but also that they can be used to adjust both the magnitude and the phase of the aperture fields in horns antennas, main reflectors and sub-reflectors.

TABLE II

Summary of the Reflector Antenna Gain With and Without a Spatial Filter Surface

| REFLECTOR CONFIGURATION | GAIN | EFFICIENCY |
|---|---|---|
| ORIGINAL REFLECTOR | 33.68 dBi | 59.16% |
| REFLECTOR WITH THE spatial filtering surface | 35.36 dBi | 87% |
| MAXIMUM THEORETICAL GAIN | 35.96 dBi | 100% |

Figure 37:
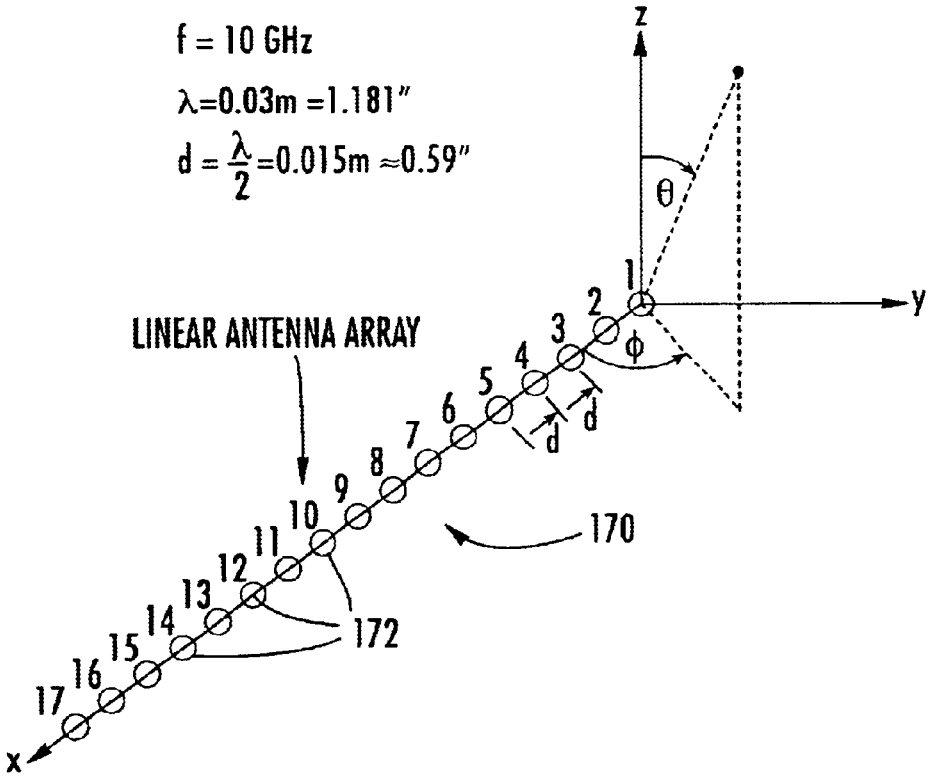
FIG. 37 is a fragmentary drawing view of a 17-element, linear antenna array that can be used with the present invention.

The present invention is also applicable to a linear antenna array. In one non-limiting example, a linear array 170 has elements positioned along the x-direction and formed from N=17 elements 172, with a $\cos^2\theta$ antenna element pattern as shown in FIG. 37. In this example, the far field radiation pattern is given by, $$E(\theta, \phi) = \sum_{i=1}^{N} V_i \cdot [\cos^2\theta] \cdot e^{jkx_i \sin\theta\cos\phi},$$

where the term $V_i$ corresponds to the element complex weight amplitude and phase. The spatial filtering surface function changes the near field of the antenna array. When a spatial filtering surface is placed above the antenna array 170, the far field given in the equation above can be approximated as follows, $$E(\theta, \phi) = \sum_{i=1}^{N} V_i \cdot E_i^{SFS}(\theta, \phi) \cdot [\cos^2\theta] \cdot e^{jkx_i \sin\theta\cos\phi},$$

where the term $E_i^{SFS}(\theta,\phi)$ defines how the spatial filtering surface alters the antenna element pattern and $$k = \frac{2\pi}{\lambda}.$$

The radiation intensity $F(\theta,\phi)$ in Watts per unit of solid angle can then be written as $$F(\theta, \phi) = \frac{1}{2\eta}|E(\theta, \phi)|^2,$$

and the directivity is given by $$D_0 = 4\pi \frac{F(\theta, \phi)|_{\max}}{\int_0^{2\pi}\int_0^{\pi} F(\theta, \phi)\sin\theta d\theta d\phi}$$

The far field beam is scanned by adjusting the progressive phase difference between elements. When a scan angle of $\theta_0$ at $\phi=0^0$ is specified, it is obtained by specifying the progressive phase shift to be $$\psi = -k \cdot d \cdot \cos\left(\frac{\pi}{2} - \theta_0\right),$$

where "d" is the separation from element to element, and ψ is the phase component of the antenna element weight.

Figure 38:
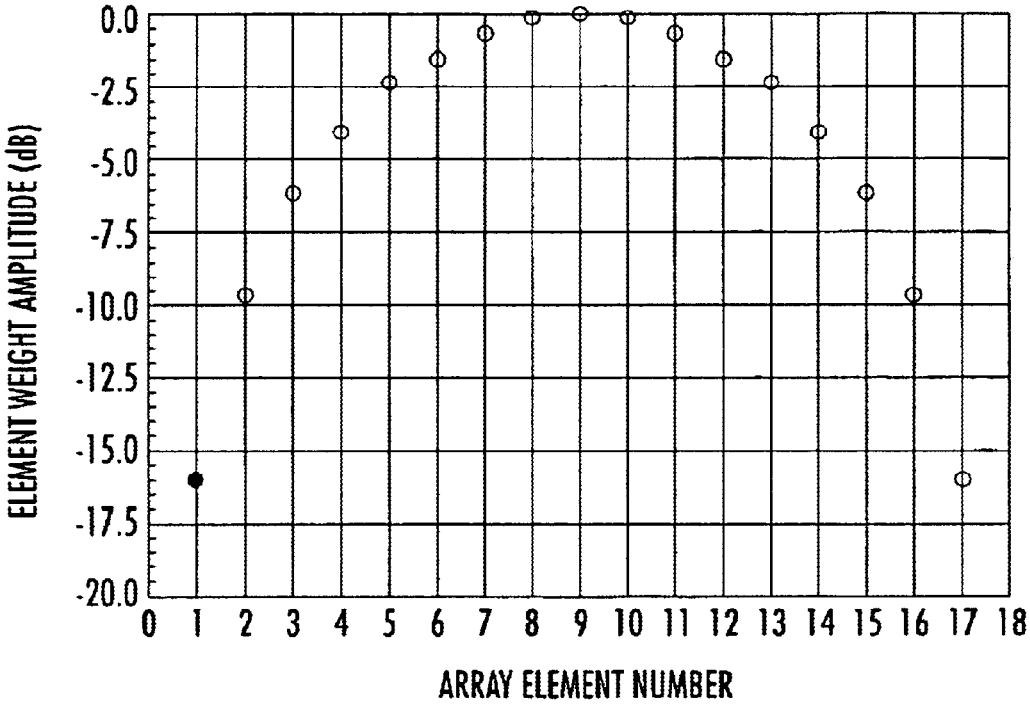
FIG. 38 is a graph showing a plot of the antenna array element number versus the element weights magnitude where the weight phases are zero.
Figure 39:
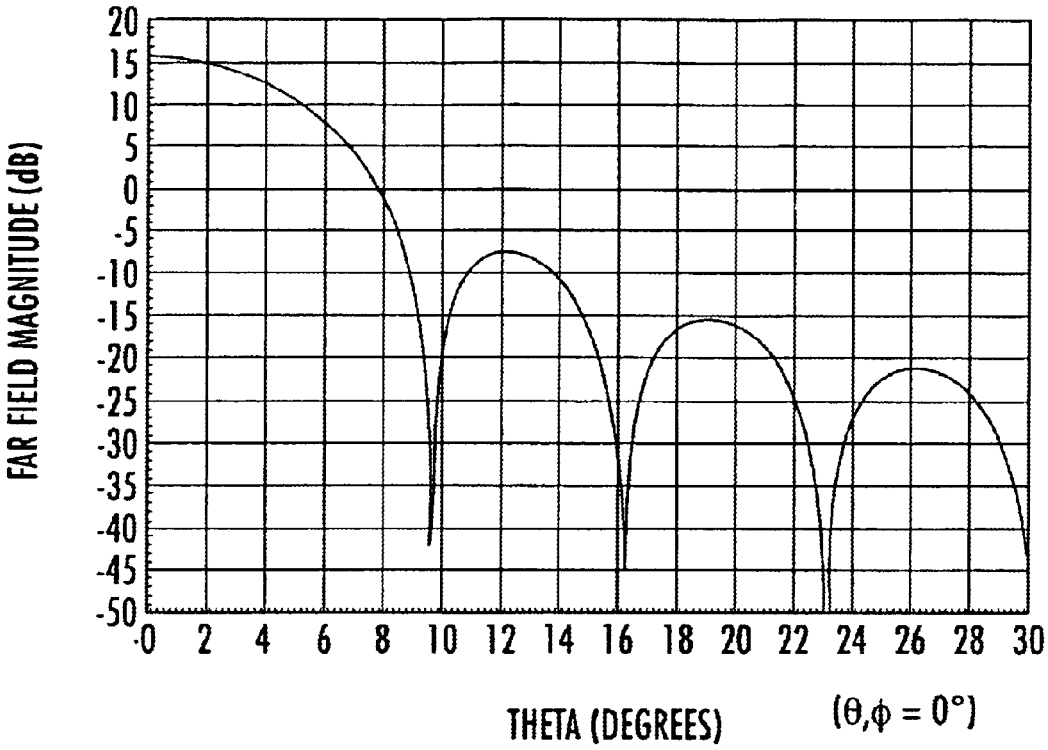
FIG. 39 is a graph showing the far field radiation pattern in dBi for the linear array.
Figure 40A:
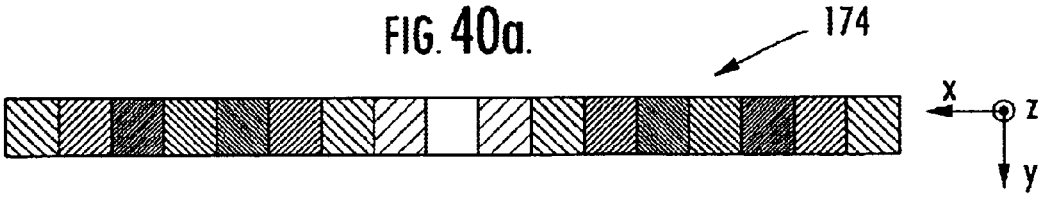
FIGS. 40A and 40B are respective fragmentary top plan and side sectional views of a spatial filtering surface used to modify the near field electric field magnitude in the aperture of the antenna array and showing that different portions of the filter change in element near field taper magnitude and phase.
Figure 40B:
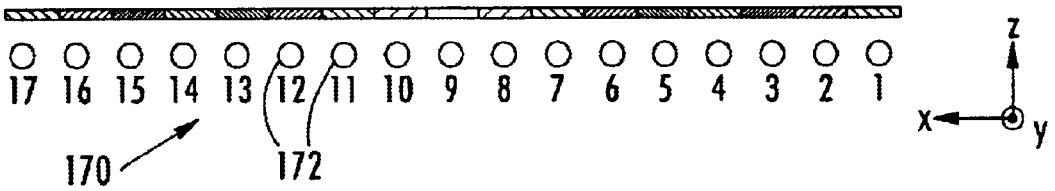
Figure 41:
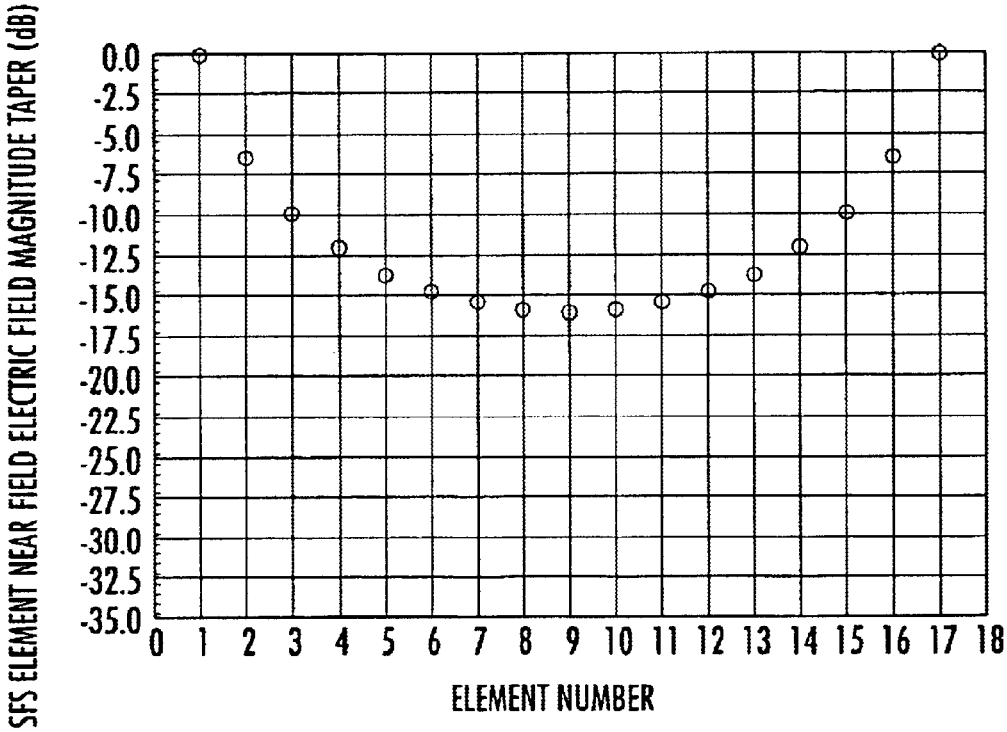
FIG. 41 is a graph showing the spatial filtering surface magnitude taper for the linear antenna array.

The amplitude weights for each antenna element are set to the values shown in the graph of FIG. 38, and the phases are set to zero. The far field radiation pattern, with a gain of 15.869 dBi, is shown in the graph of FIG. 39. A spatial filtering surface 174 is placed over the antenna array elements as shown in FIG. 40. The spatial filtering surface modifies the near electric field magnitude or aperture field of the antenna array. Corresponding elements have corresponding taper magnitude and taper phase, as illustrated. A graph of spatial filtering surface device taper is shown in FIG. 41.

Figure 42:
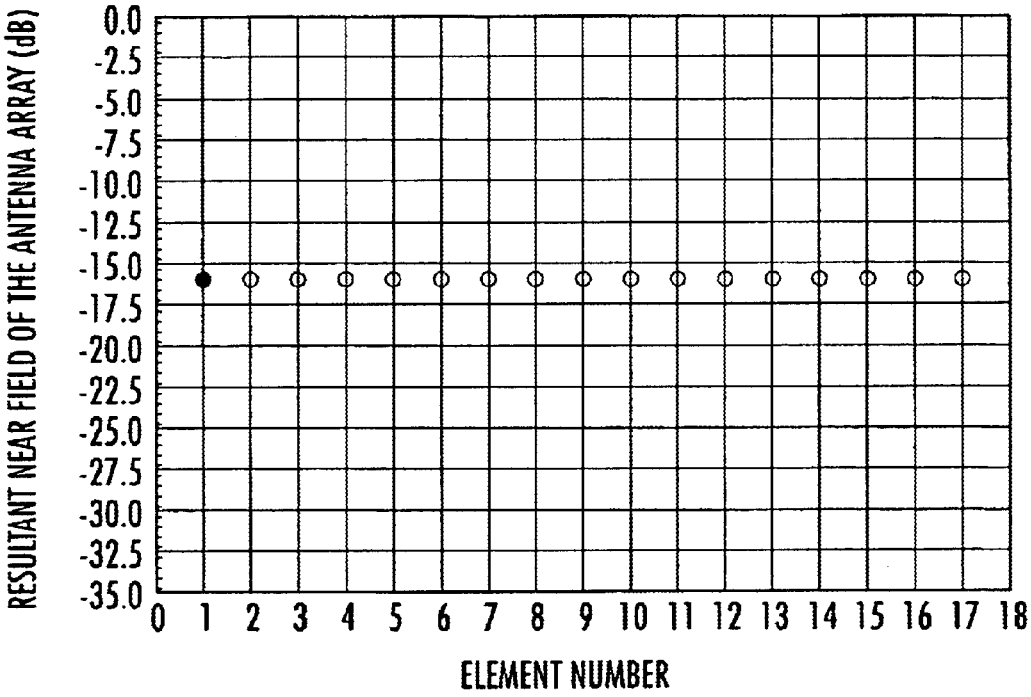
FIG. 42 is a graph showing the resultant antenna array aperture taper after placing the spatial filtering surface device over the antenna array and showing the element number on the x-axis and the resultant near field of the antenna array in decibels on the y-axis.
Figure 43:
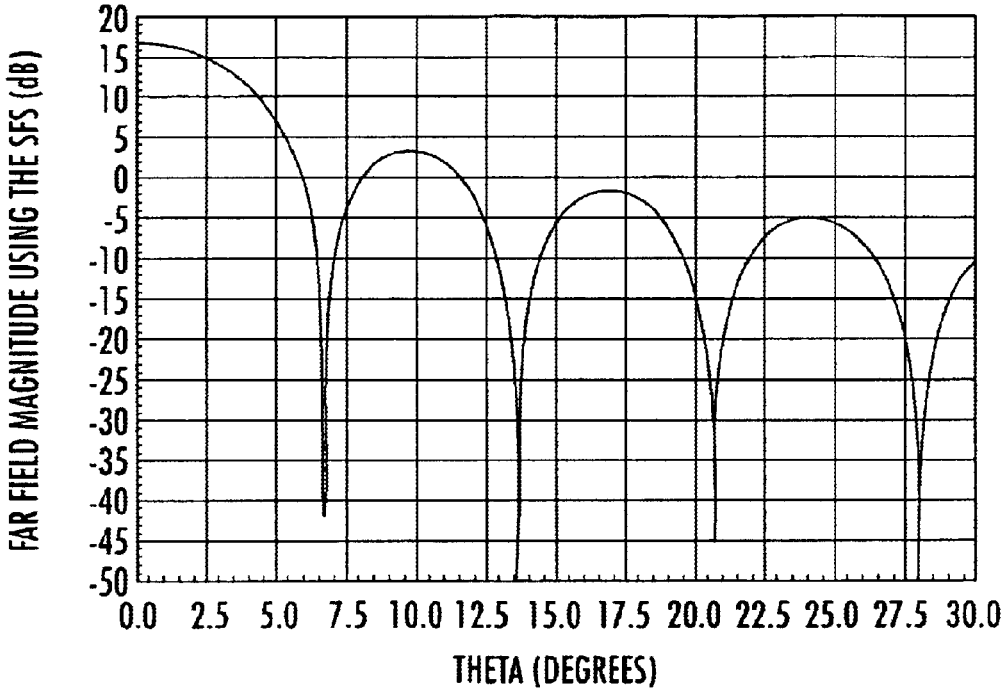
FIG. 43 is a graph showing the far field of the antenna array when the spatial filtering surface device of the present invention is used on the near field aperture fields of the linear antenna array.
Figure 44:
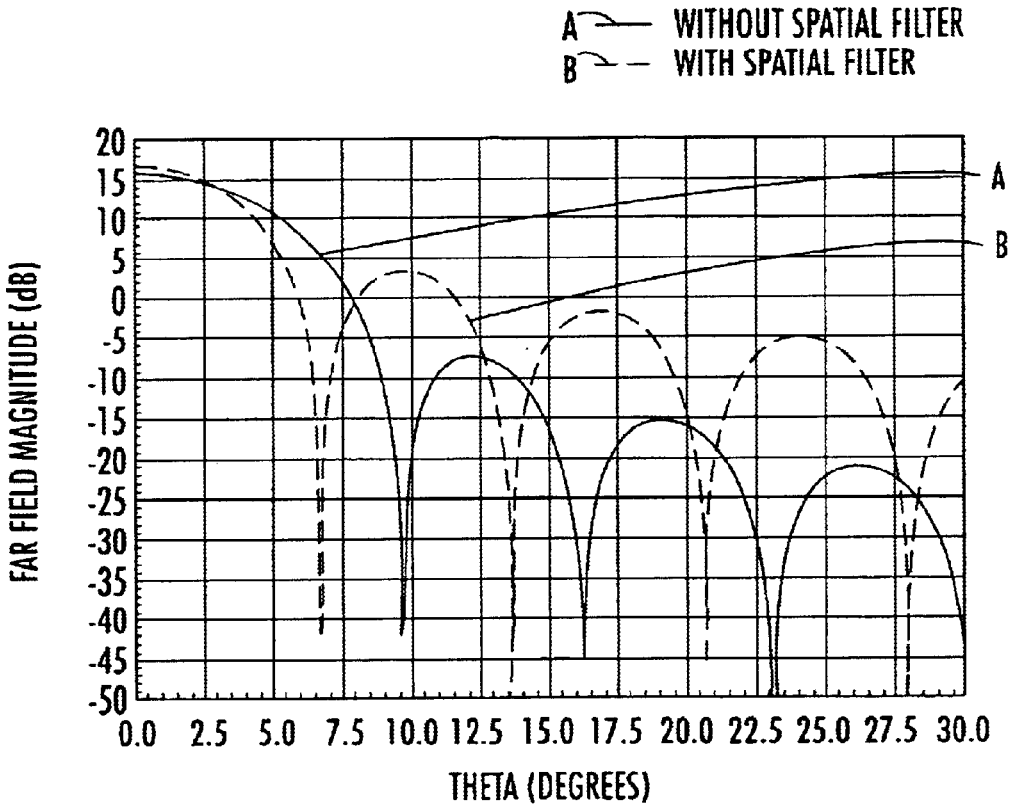
FIG. 44 is a graph showing the comparison of the antenna array far field radiation pattern with and without the spatial filtering surface of the present invention and showing how the spatial filtering surface device increased the gain and the sidelobes of the linear antenna array.

The approximated resultant near field, after using the spatial filtering surface is shown in the graph of FIG. 42, where uniform aperture fields were obtained. In this case, the interaction or electromagnetic coupling between the array and the spatial filtering surface was neglected. The far field pattern of the antenna array, with the spatial filtering surface, is shown in the graph of FIG. 43, where the antenna gain increased to 16.679 dBi. This example shows that the antenna array aperture efficiency increased by tapering the near field electric field magnitude or aperture field's magnitude. The antenna array far fields, with and without the spatial filtering surface, are compared in the graph of FIG. 44, where it can be seen clearly that the spatial filtering surface increased the antenna gain and the sidelobes of the antenna array far field antenna radiation pattern.

Figure 45A:
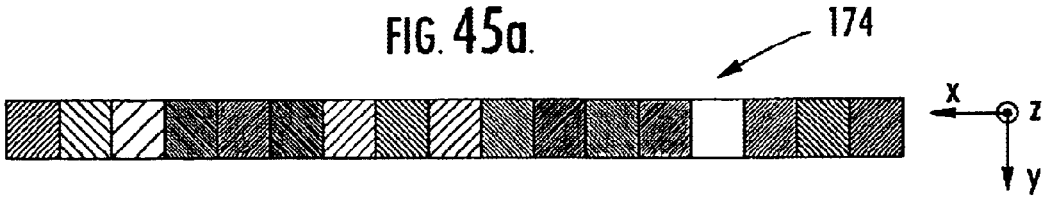
FIGS. 45A and 45B are drawing views similar to FIGS. 40A and 40B and showing a view of the spatial filtering surface device used to modify the near aperture field electric field phase where the amplitude shown in FIGS. 40A and 40B was used and showing the taper phase corresponding to a particular element near field.
Figure 45B:
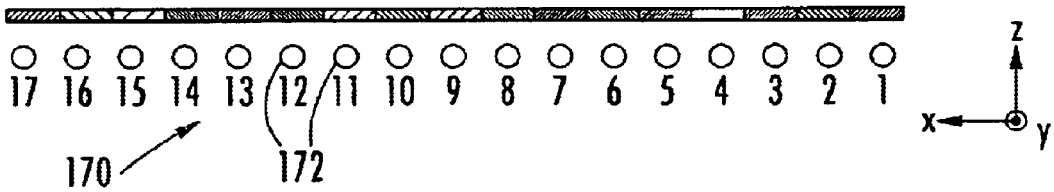
Figure 46:
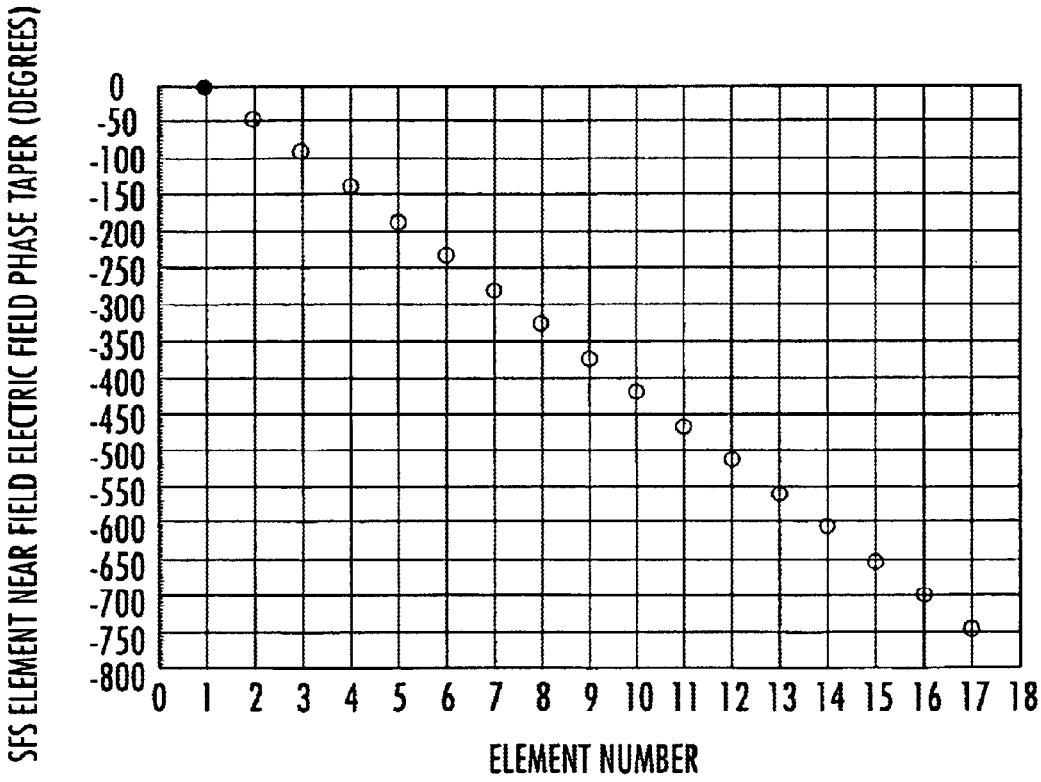
FIG. 46 is a graph illustrating the spatial filtering surface phase taper for the linear antenna array and showing element numbers on the x-axis and the near field electric field phase taper in degrees on the y-axis.

Another application of the spatial filtering surface is for the progressive tapering of the phase along array elements. The same spatial filtering surface used to taper the array element magnitude can be used, but the phase of each element can be adjusted as shown in FIGS. 45A and 45B and the graph of FIG. 46. In FIGS. 45A and 45B, the amplitude shown in FIG. 40 was used.

Figure 47:
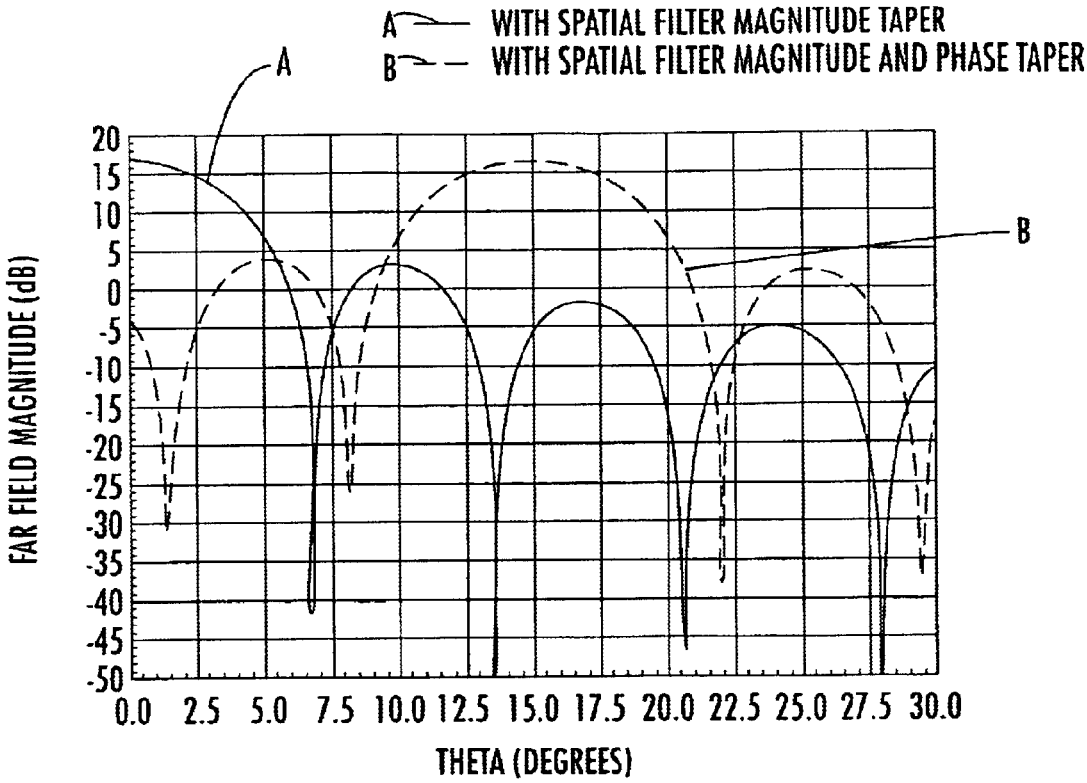
FIG. 47 is a graph illustrating a comparison of the antenna array far fields with a spatial filtering surface using a magnitude taper only, and with a spatial filtering surface using magnitude and phase tapers.

The progressive phase shift quantity of $$\psi = -k \cdot d \cdot \cos\left(\frac{\pi}{2} - \theta_0\right),$$

was used for scanning the beam to the position θ=15° and ϕ=0°. The far fields for the antenna array with the spatial filtering surface magnitude taper only, and with the spatial filtering surface device magnitude and phase tapers, are shown in FIG. 47. The beam was scanned to 15 degrees, and the sidelobe structure was altered after the beam was scanned. Therefore, it can be stated that the phase of the element weights has an effect on the antenna array sidelobes. In addition, the antenna array gain decreased slightly to 16.668 dBi after the phase taper was applied. The tabulated gain and efficiency numbers for the cases studies are shown in Table III.

TABLE III

Summary of the Antenna Array Gain Without a Spatial Filter and With Two Different Types of Spatial Filters

| ARRAY CONFIGURATION | SCAN ANGLE | GAIN |
|---|---|---|
| ARRAY WITH ORIGINAL WEIGHTS | θ = 0°, ϕ = 0° | 15.869 dBi |
| ARRAY WITH SPATIAL MAGNITUDE TAPER | θ = 0°, ϕ = 0° | 16.679 dBi |
| ARRAY WITH SPATIAL MAGNITUDE AND PHASE TAPER | θ = 15°, ϕ = 0° | 16.668 dBi |

Different elements, with different sizes can be used to taper the aperture field magnitude. These elements can be made of metallic or resistive materials as explained before and shown in FIGS. 22A, 22B and 31A and 31B. The elements can have a variety of inter-element spacing and be placed at any location in a three-dimensional lattice, or be placed in a curved surface as shown in FIGS. 23A, 23B, 32A and 32B. Ideally, these spatial filtering surfaces can be manufactured using parts that meet any required specifications for magnitude tapers at the required frequencies. In addition, lossy materials can be used for tapering the electric field amplitude.

Figure 48:
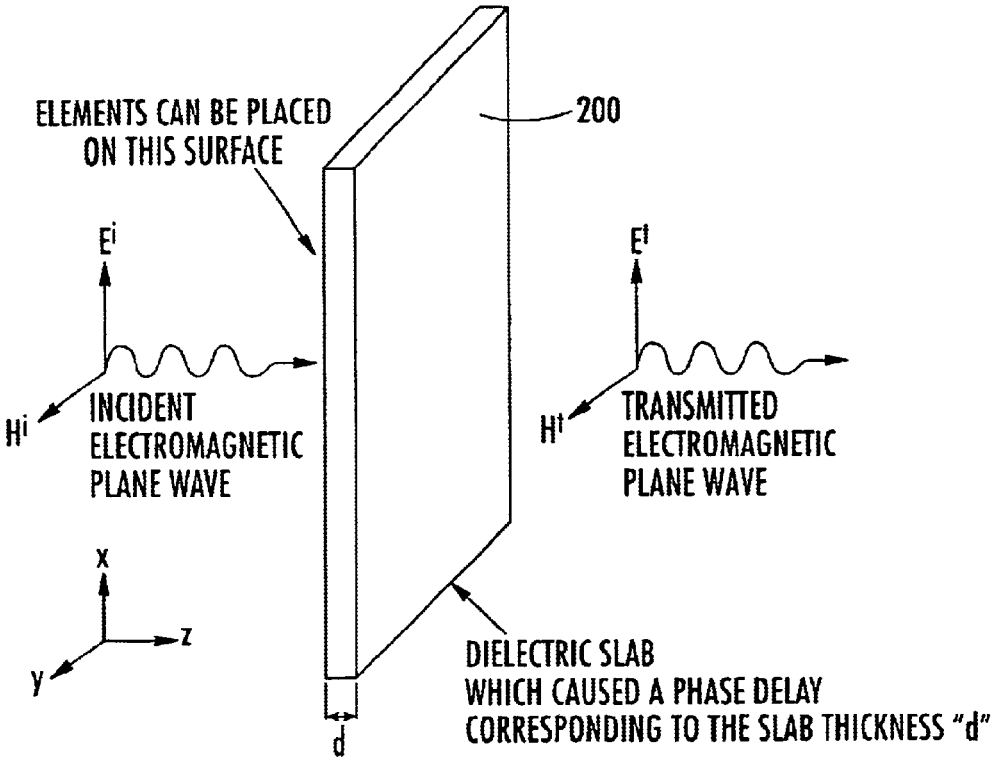
FIG. 48 is a fragmentary, isometric view showing both an incident and transmitted electromagnetic plane wave, and showing a phased delay corresponding to a dielectric layer.

FIG. 48 illustrates the basic mechanism of a phase taper. Elements (not shown) are placed on the dielectric surface 200. The drawing shows the incident and transmitted plane electromagnetic wave, showing a phase delay corresponding to the dielectric thickness and dielectric constant. The incident plane wave is operative with electric field $\overline{E}^i$ and magnetic field $\overline{H}^i$. The electric and magnetic fields are given by the following equations:

$$\overline{E}^i = \hat{x}E_0 \cdot e^{-jkz},\ \overline{H}^i = \hat{y}\frac{E_0}{\eta}e^{-jkz},$$

$$\text{where } k = \frac{2\pi}{\lambda}, \text{ and } \eta = 120\pi\,\Omega \approx 376.99\,\Omega$$

is the intrinsic impedance of free space. The transmitted fields are given by:

$$\overline{E}^t = \hat{x} \cdot T(d) \cdot e^{-jkd} \cdot E_0 \cdot e^{-jkz},\ \overline{H}^t = \hat{y}\frac{E_0}{\eta}T(d) \cdot e^{-jkd}e^{-jkz},$$

where "T(d)" is the transmission coefficient through the dielectric slab, and the term $e^{-jk \cdot d}$ adds a phase delay to the transmitted fields, corresponding to the thickness and the dielectric constant of the layer. In addition, any combination of layers (slabs) can be made. The transmission coefficient T(d) can also alter the magnitude when elements (metallic or resistive) are used, or when the transmission coefficient T(d) includes a loss mechanism. Also, it is important to point out, that elements, such as the ones shown in FIGS. 2A–2O, can have different phase delays as an electromagnetic wave goes through them. Therefore, the phase delay feature of the spatial filtering surface can be achieved with one or more surfaces. The elements can also be planar or three-dimensional. Moreover, there can be one or more layers of dielectrics, arranged in any combination, in a way that the specified phase shift, at the desired frequencies, is achieved.

The functionality of a passive array made of resonant or non-resonant elements can be expanded to the functionality required by a scanning array antenna. This needed functionality requires the change of the antenna array, near field amplitude and phase in real time. This functionality can be achieved by adding active devices to the passive spatial filtering surface. These active devices could include varactor diodes, p-i-n diodes, metal-enhanced semiconductor transistors, etc. An active spatial filtering surface 210 is shown in FIGS. 49A, 49B, 49C and 49D, where a passive array of loaded dipoles is an active surface after connecting the dipole ends with varactor diodes, and adding bias lines.

FIG. 49A shows the incident electric field as polarized in the Y-direction. The original passive resonant grid is formed by loaded dipole elements 212, as shown in this front side elevation view. As shown in the FIG. 49B elevation view, the equivalent circuit for the loaded dipoles is illustrated where the gaps 214 are modeled as capacitors and the wire elements as inductors.

FIG. 49C illustrates the varactor diode 216 where the active version of the resonant loaded dipoles with varactor diodes connect the dipoles 212. In FIG. 49D, bias lines 218 are illustrated and the active version of the resonant loaded dipoles with varactor diodes connect the dipoles, including the required bias lines of the varactors.

The equivalent circuit of a loaded dipole array contains capacitors because of gaps, and inductors because of the wire inductance of the loaded dipole element. The capacitance of a varactor diode can be changed with a bias current, thus effectively changing the inter-element spacing between elements of a comparable passive device. The bias current lines can be metallic for voltage controlled varactor diodes, or optical for light controlled varactor diodes. This active spatial filtering surface 210 can be used to control the amplitude taper and the reflection and/or transmission phase. If a transmission phase taper is required, several layers of non-resonant elements can be stacked. Dielectric slabs or layers can be used to adjust the transmitted phase, by adjusting the dielectric constant of the dielectric slab with an applied voltage. Additional active devices and design techniques, as suggested by those skilled in the art, can be used for the active spatial filtering technology.

As noted before, the present invention is advantageous and allows the application of spatial filtering surfaces for increasing antenna efficiency. Active spatial filtering devices for phased arrays can also be used where real time scanning is achieved through the modification of the antenna array near field magnitude and phase in real time.

The aperture fields of a reflector could be tapered using spatial filtering surfaces. The array far field radiation pattern equation in terms of the weights, and the element spatial location in the spherical coordinate system, is applicable to how the spatial filtering surface devices operate in an array environment. The spatial filtering surfaces could be placed in close proximity of an array. The spatial filtering surface of the present invention can replace or enhance the function of the traditional antenna array elements weights.

Another advantage of using spatial filters in antenna design is the simplification of the antenna design process. For example, an antenna array can be made of elements with uniform weights, and the electronics required for the weights amplitude and phase do not have to be implemented at the array level. Instead, a separate spatial filtering surface can provide the magnitude and the phase tapers. The spatial filtering surface can also be used to simplify the design of feed horns for reflectors, and as an alternative to surface shaping of reflectors. New types of antennas can also be made using the spatial filtering surface features. For example, a planar configured spatial filtering surface can be illuminated by a feed horn or other antenna. The reflected phase and magnitude can be electronically controlled in order to achieve a desired far field pattern, with the specified efficiency and sidelobe levels.

The present description has proceeded with how the far field radiation pattern could be changed by adjusting the aperture fields. As the spatial filtering surface couples with the antenna, however, the incident field on the spatial filtering surface induces currents in the spatial filtering surface elements, which then radiate to the far field. The spatial filtering surface can be considered a second antenna with its own far field radiation pattern. The far field radiation pattern will be the composite of the antenna radiated fields and the spatial filtering surface radiated fields. An analysis can be performed using a spatial filtering surface and an isotropic source. A linear array example is used, in one non-limiting example, where the gain increases while reducing the sidelobes, when a spatial filtering surface is used.

When a spatial filtering surface is placed in close proximity to an antenna, it couples strongly with it. The incident fields in the spatial filtering surface induce surface currents in the spatial filtering surface elements, and transmitted fields and reflected fields are produced. The reflected fields return to the antenna, where surface currents are induced. A mutual electromagnetic interaction develops which changes the antenna element input impedance, and the current distribution in the antenna element and the spatial filtering surface.

The spatial filtering surface elements also may or may not be resonant at the frequency of the antenna. The fields, however, radiated by resonant spatial filtering surface elements will be stronger than the fields radiated by non-resonant spatial filtering surface elements.

A spatial filtering surface is applied to a linear antenna array, and the gain is increased while reducing the sidelobes. As noted before, when the taper of an antenna is changed, the far field pattern characteristics such as gain and sidelobes are changed. It should be understood that there is some significance of the electromagnetic coupling between the spatial filtering surface and the aperture antenna.

If an isotropic source 72 radiates in free space, as shown in FIG. 6, the far field pattern of an isotropic source is given by $F(\theta,\phi)=1$, which states that the isotropic source 72 radiates identically in all directions. Hence, the directivity of the isotropic source is given by:

$$D_0 = 4\pi\frac{F(\theta,\phi)|_{\max}}{\int_0^{2\pi}\int_0^{\pi}F(\theta,\phi)\sin\theta d\theta d\phi} = 4\pi\frac{1}{\int_0^{2\pi}\int_0^{\pi}\sin\theta d\theta d\phi},\ D_0 = 1$$

$D_0=1$. Hence, the directivity of an isotropic source is one. If the isotropic source is placed at a close distance from the spatial filtering surface 76 as shown in FIG. 7, the isotropic source becomes electromagnetically coupled with the spatial filtering surfaces device. The incident near fields into the spatial filtering surface 76 induce surface currents in the spatial filtering surface elements, and between the spatial filtering surface elements, which cause to the spatial filtering surfaces device to radiate as shown in FIG. 8.

Figure 50:
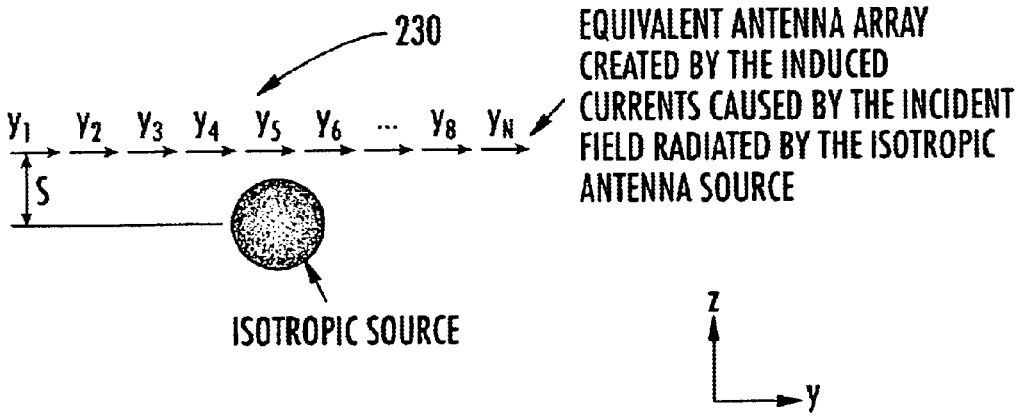
FIG. 50 is a fragmentary plan view of an antenna system as an isotropic source and a spatial filtering surface where the induced currents are caused by the incident field radiated by the isotropic antenna source.

The incident fields generated by the isotropic source induce surface currents in the spatial filtering surface, and transmitted fields and surface waves are generated according to the boundary conditions. Thus, the spatial filtering surface becomes an equivalent second antenna as shown in FIG. 50, which shows the equivalent antenna array 230 created by the induced surface currents caused, in turn, by the incident field radiated by the isotropic antenna source. Consequently, the resulting far fields will be the superposition of the radiated fields from the isotropic antenna source and the spatial filtering surfaces equivalent antenna, which are separated by a distance "s". Hence, the spatial filtering surface behaves like a second antenna, which can be modeled as an antenna array. The far field radiation pattern equation of an isotropic source with a spatial filter surface can be approximately formulated as follows:

$$E(\theta,\phi) = V_{\text{isotropic_source}}\cdot e^{-jk\frac{s}{2}\cos\theta} + \sum_{i=1}^{N} W_i\cdot T_i(\theta,\phi)\cdot e^{jk\left(y_i\sin\theta\sin\phi+\frac{s}{2}\cos\theta\right)},$$

where $W_i$ is the complex weight for each spatial filtering surfaces equivalent antenna element. $T(\theta,\phi)$ is the element pattern for each spatial filtering surface equivalent antenna element, and the term $$jk\left(y_i\cdot\sin\theta\sin\phi+\frac{s}{2}\cdot\cos\theta\right)$$

provides information about the location $y_i$ of each spatial filtering surface element. The variable "s" is the distance in the z-direction between the isotropic source and the spatial filtering surface equivalent antenna array. In addition, $V_{isotropic_source}$ is the complex weight associated with the isotropic source, which results from the electromagnetic coupling with the spatial filtering surface equivalent antenna array.

The radiation intensity F(θ,φ) in Watts per unit of solid angle can be written as, $$F(\theta, \phi) = \frac{1}{2\eta}|E(\theta, \phi)|^2,$$

and the directivity is, $$D_1 = 4\pi \frac{F(\theta, \phi)|_{\max}}{\int_0^{2\pi}\int_0^{\pi} F(\theta, \phi)\sin\theta\, d\theta\, d\phi}.$$

By looking at the above equations, it is obvious that the radiation pattern E(θ,φ) will be affected by the presence of the spatial filtering surface, thus affecting antenna far field parameters such as the directivity and the sidelobe levels.

As shown in FIG. 53, a linear array includes elements along the x-direction of N=17 elements, with a $\cos^2\theta$ element pattern. The far field radiation pattern is given by, $$E(\theta, \phi) = \sum_{i=1}^{N} V_i \cdot [\cos^2\theta] \cdot e^{jkx_i \sin\theta\cos\phi},$$

where the term $V_i$ corresponds to the element complex weight amplitude and phase. The spatial filtering surface function changes the near field of the antenna array as it couples with it. The electromagnetic coupling effects on the far field of the antenna array/spatial filtering surfaces array system can be approximately expressed as follows, $$E(\theta, \phi) = \sum_{i=1}^{N} V_i \cdot E_i^{SFS}(\theta, \phi) \cdot [\cos^2\theta] \cdot e^{jkx_i \sin\theta\cos\phi} + \sum_{i=1}^{N} W_i \cdot T_i(\theta, \phi) \cdot e^{jk(x_i \sin\theta\cos\phi + s\cos\theta)},$$

where the term $E_i^{SFS}(\theta,\phi)$ defines how the spatial filter spatial filtering surface alters the array element pattern and the complex weight $V_i$ in the near field. The wavevector k is $$k = \frac{2\pi}{\lambda}.$$

The term $W_i$ corresponds to the complex weight of the equivalent spatial filtering surface antenna elements, $T_i(\theta,\phi)$ is the equivalent spatial filtering surface antenna element pattern, and the term $jk(x_i \cdot \sin\theta \cdot \cos\phi + s \cdot \cos\theta)$ provides information about the location $x_i$ of each spatial filtering surfaces element. The variable "s" is the z-directed distance between the array and the spatial filtering surfaces device. The variable "M" is the number of spatial filtering surface elements, and it is chosen to be equal to "N=17" for convenience. The radiation intensity F(θ,φ) in Watts per unit of solid angle can then be written as, $$F(\theta, \phi) = \frac{1}{2\eta}|E(\theta, \phi)|^2,$$

and the directivity is given by the equation, which is rewritten next for convenience.

$$D_0 = 4\pi \frac{F(\theta, \phi)|_{\max}}{\int_0^{2\pi}\int_0^{\pi} F(\theta, \phi)\sin\theta\, d\theta\, d\phi}.$$

Figure 51:
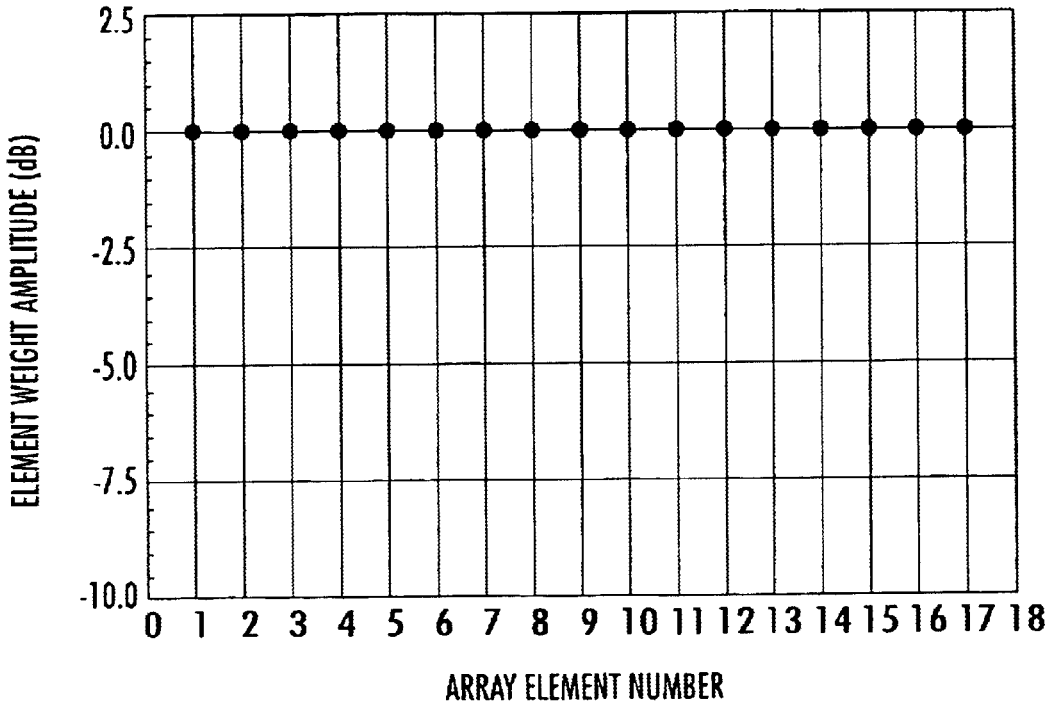
FIG. 51 is a graph showing the antenna array element weights magnitude where the weight phases are zero and showing the array element number on the x-axis and the element weight amplitude in decibels on the y-axis.
Figure 52:
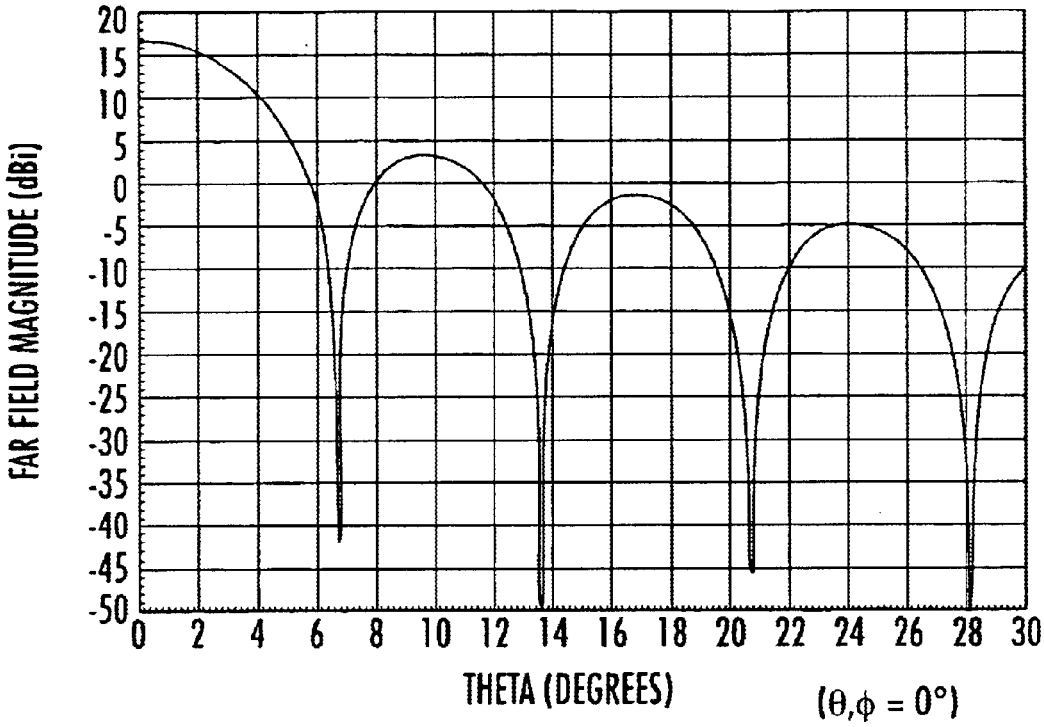
FIG. 52 is a graph showing the original antenna array far field radiation pattern.

The amplitude weights for each array element are set to the values shown in FIG. 51, and the phases are set to zero. The far field radiation pattern, with a gain of 16.68 dBi and a sidelobe level of −13.4 dB, is shown in FIG. 52. A spatial filtering surface 240 is placed over the antenna array elements 242, as shown in FIGS. 53A and 53B. The spatial filter is used to modify the near field electric field of the antenna array. The coupling induced weight for each colored section is $W=0.5 \cdot e^{-j \cdot 130°}$, i.e., each element has a phase of −130°.

Figure 54:
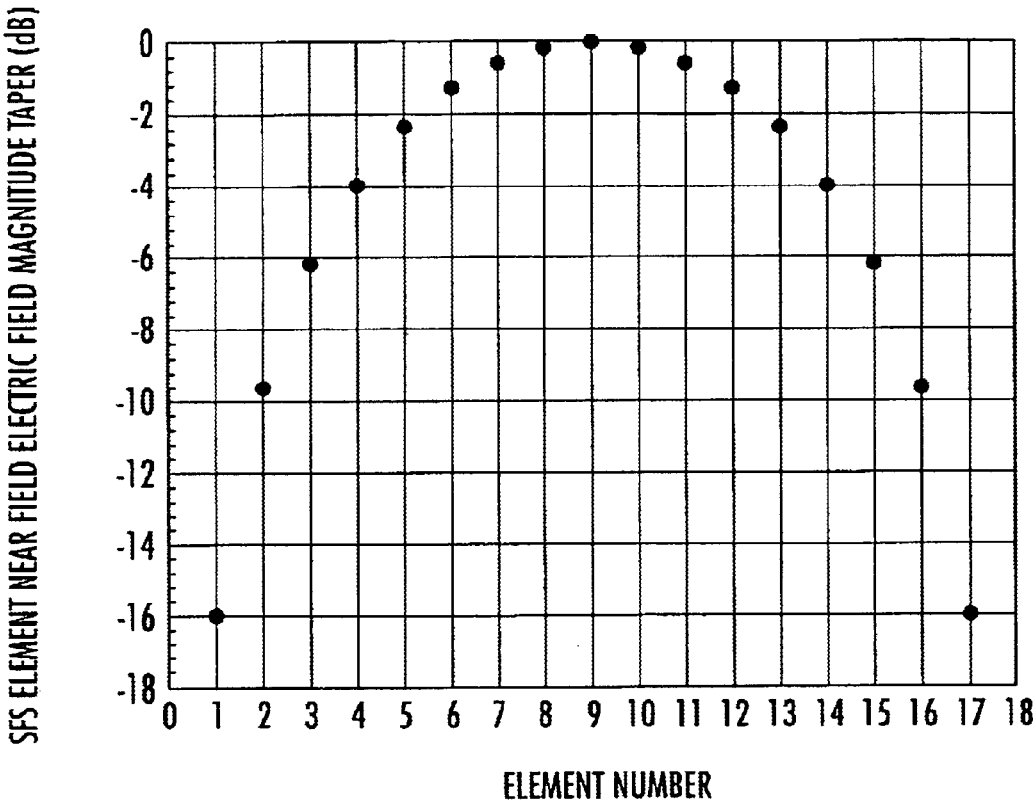
FIG. 54 is a graph showing the spatial filtering surface actual device magnitude taper for the antenna array of FIG. 53.
Figure 55:
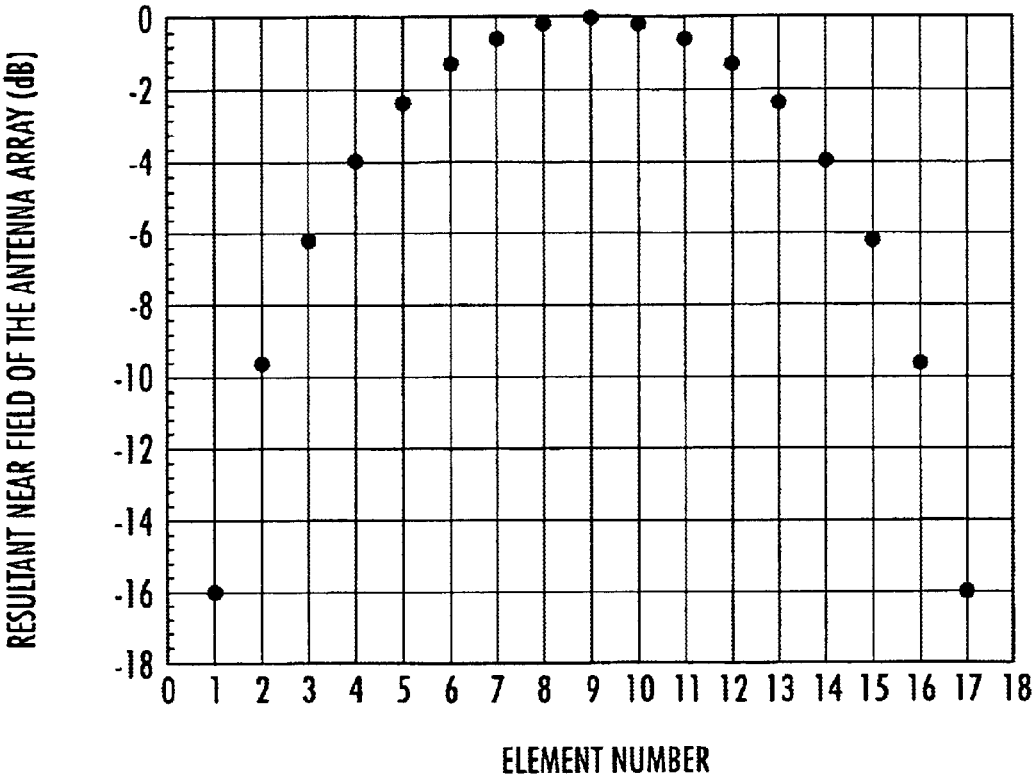
FIG. 55 is a graph illustrating the resultant antenna array near field aperture taper after placing the spatial filtering surface over the array.

The spatial filtering surface device taper for normal incidence is shown in FIG. 54. The approximated resultant near field, after using the spatial filtering surface is shown in FIG. 55, where the taper is identical to the one shown in FIG. 54. The neglected electromagnetic coupling will cause differences between FIGS. 54 and 55. An accurate means of doing this work is by using an advanced numerical method such as the Method of Moments, Finite Elements, the Finite Difference Time Domain, and other techniques known to those skilled in the art. The weights for the equivalent spatial filtering surface antenna element were estimated to be, $W_i=0.5 \cdot e^{-j130°}$. These weights were introduced to explain the effects of the electromagnetic coupling between the antenna and the spatial filter surface.

The phase of −130° was added to the spatial filtering surface equivalent antenna element weight because it has been found that the phase is critical in achieving a higher gain, while reducing the sidelobes through the aperture magnitude tapering. These non-limiting weight numbers were picked for illustration purposes only. The actual numbers can be found using more rigorous analysis techniques. In addition, the element pattern for each spatial filtering surface element is assumed to be isotropic, that is, $T_i(\theta,\phi)=1$, and the location of each spatial filtering surface equivalent array element is identical to the antenna array elements for convenience, i.e., $x_i$. The separation between the array and the spatial filtering surface, in the z-direction is selected to be s=0.25λ=0.2952".

Figure 56:
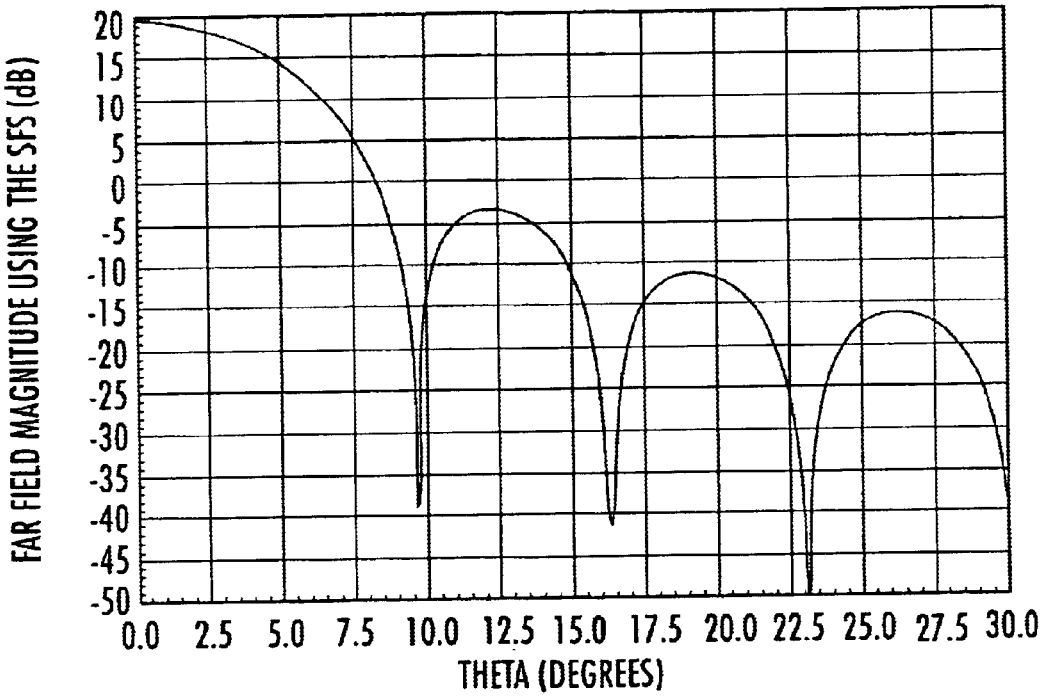
FIG. 56 is a graph showing the far field of the antenna array when the spatial filtering surface is used.
Figure 57:
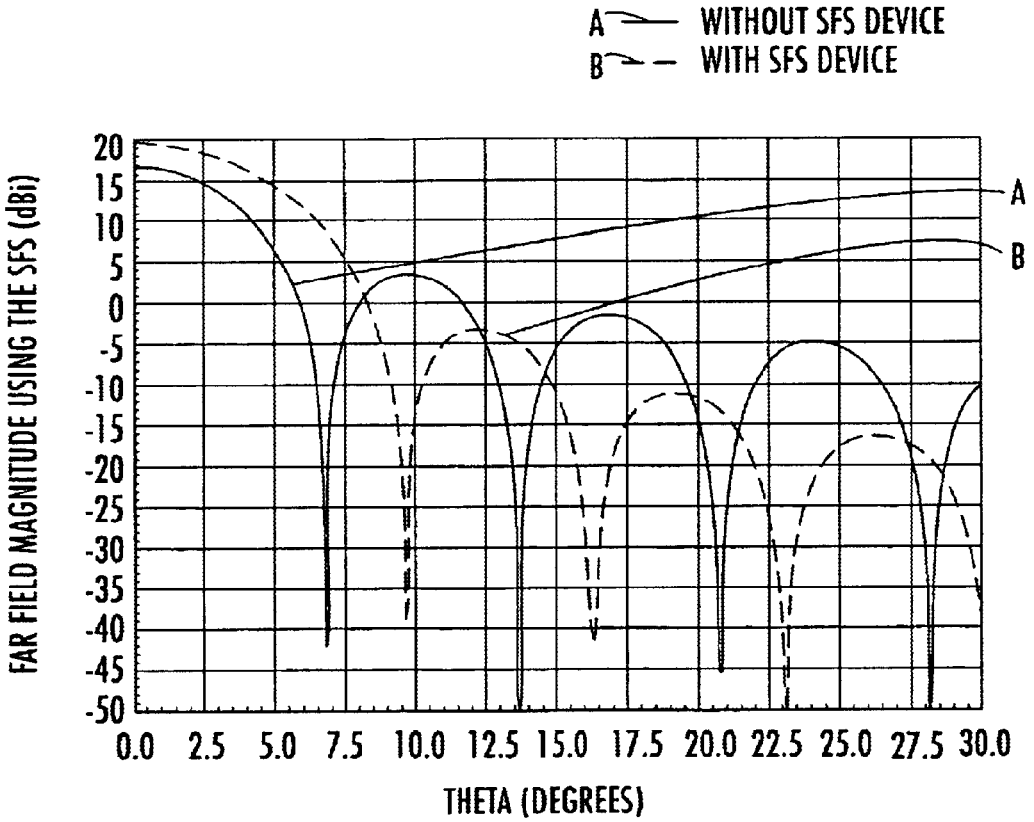
FIG. 57 is a comparison of the antenna array far fields with and without the spatial filtering surface, where the antenna array gain is increased while reducing the sidelobes for the spatial filter case.

The far field pattern of the antenna array, with the spatial filtering surface, is shown in FIG. 56, where the antenna gain increased to 19.43 dBi, with a sidelobe level of −23.1 dB. This example shows that the antenna array resultant aperture efficiency increased by tapering the near field electric field magnitude, while reducing the sidelobes. The antenna array far fields, with and without the spatial filtering surface, are compared in FIG. 57, where it can be seen clearly that the spatial filtering surface increased the antenna gain while reducing the sidelobe levels of the antenna array far field radiation pattern. The tabulated gain and sidelobe level numbers are shown in Table IV.

TABLE IV

Summary of the Antenna Array Gain and Sidelobe Levels with and Without the SFS Device

| ARRAY CONFIGURATION | SCAN ANGLE | SIDELOBE LEVEL | GAIN |
|---|---|---|---|
| ARRAY WITH ORIGINAL WEIGHTS | $\theta = 0°, \phi = 0°$ | −13.4 dB | 16.68 dBi |
| ARRAY WITH SPATIAL MAGNITUDE TAPER (USED COUPLING MODEL) | $\theta = 0°, \phi = 0°$ | −23.1 dB | 19.43 dBi |

This application is related to copending patent applications entitled, "ANTENNA SYSTEM WITH ACTIVE SPATIAL FILTERING SURFACE," and "SPATIAL FILTERING SURFACE OPERATIVE WITH ANTENNA APERTURE FOR MODIFYING APERTURE ELECTRIC FIELD," which are filed on the same date and by the same assignee and inventors, the disclosures which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna system comprising:

a ground plane;

a plurality of antenna elements forming an antenna array; and a substantially planar spatial filtering surface positioned adjacent the antenna array through which electromagnetic radiation to or from the antenna array passes, said spatial filtering surface comprising a substantially planar dielectric substrate, a plurality of spaced, geometric configured, resonant elements printed on the dielectric substrate and configured and spaced from each other to have a resonant frequency to filter an electromagnetic field at a selected frequency with respect to an angle of incidence to the dielectric substrate, and a dielectric filler positioned between, above and below each resonant element printed on the dielectric substrate and forming a substantially planar spatial filtering surface, wherein a spatial filter taper transform is imparted when electromagnetic radiation passes therethrough and a standing wave is created between the ground plane and/or antenna and spatial filtering surface.

2. An antenna system according to claim 1, wherein said resonant elements are formed by a plurality of wire elements printed on the dielectric substrate.

3. An antenna system according to claim 2, wherein said wire elements are configured as hexagons.

4. An antenna system according to claim 1, and further comprising a metallic layer disposed on the dielectric layer, and wherein said resonant elements are formed am geometric configured slots within the metallic layer.

5. An antenna system according to claim 4, wherein said geometric configured slots are formed as hexagons.

6. An antenna system according to claim 1, wherein said dielectric substrate comprises a plurality of dielectric layers.

7. An antenna system according to claim 1, and further comprising a dielectric layer overlying said resonant elements.

8. An antenna system according to claim 7, wherein said dielectric layer overlying said resonant elements comprises a plurality of dielectric layers.

9. An antenna system according to claim 1, wherein said filler comprises an adhesive film.

10. An antenna system according to claim 1, wherein said filler is formed from an air gap between, above and below resonant elements.

11. An antenna system according to claim 1, wherein said spatial filtering surface is formed as a multilayer layer spatial filtering surface comprising a plurality of spaced dielectric substrates each forming a spatial filtering surface layer having the resonant elements printed thereon.

12. An antenna system according to claim 11, wherein an air gap is formed between said spatial filtering surface layers.

13. An antenna system according to claim 11, and further comprising a dielectric layer positioned between said spatial filtering surface layers.

14. An antenna system according to claim 11, wherein the distance between spatial filtering surface layers, the dielectric constant of dielectric substrates and permeability of dielectric substrates are chosen to impart a desired spatial filter surface taper transform.

15. A multilayer spatial filtering surface used with an antenna system comprising:

a substantially planar dielectric substrate forming a spatial filtering surface layer and having a plurality of spaced, geometric configured, resonant elements printed on the substantially planar dielectric substrate and configured and spaced from each other to have a resonant frequency to filter an electromagnetic field at a selected frequency with respect to an angle of incidence to the dielectric substrate, and a dielectric filler positioned between, above and below each resonant element printed on the dielectric substrate to form a substantially planar spatial filtering surface, wherein a spatial filter surface taper transform is imparted thereto when electromagnetic radiation passes therethrough.

16. A multilayer spatial filtering surface according to claim 15, wherein an air gap is formed between said spatial filtering surface layers.

17. A multilayer spatial filtering surface according to claim 15, and further comprising a dielectric layer positioned between said spatial filtering surface layers.

18. A multilayer spatial filtering surface according to claim 15, wherein the distance between spatial filtering surface layers, the dielectric constant of dielectric substrates, and permeability of dielectric substrates are chosen to aid in imparting a desired spatial filter surface taper transform.

19. A multilayer spatial filtering surface according to claim 15, wherein said resonant elements are formed by a plurality of wire elements printed on the dielectric substrate.

20. A multilayer spatial filtering surface according to claim 19, wherein said wire elements are configured as hexagons.

21. A multilayer spatial filtering surface according to claim 15, and further comprising a metallic layer disposed on the dielectric layer, and wherein said resonant elements are formed as geometric configured slots within the metallic layer.

22. A multilayer spatial filtering surface according to claim 21, wherein said geometric configured slots are formed as hexagons.

23. A multilayer spatial filtering surface according to claim 15, wherein said dielectric substrate comprises a plurality of dielectric layers.

24. A multilayer spatial filtering surface according to claim 15, and further comprising a dielectric layer overlying said resonant elements.

25. A multilayer spatial filtering surface according to claim 24, wherein said dielectric layer overlying said resonant elements comprises a plurality of dielectric layers.

26. A multilayer spatial filtering surface according to claim 15, wherein said filler comprises an adhesive film.

27. A multilayer spatial filtering surface according to claim 15, wherein said filler is formed from an air gap between, above and below resonant elements.

28. A spatial filtering surface used with an antenna system comprising:

a substantially planar dielectric substrate;

a plurality of spaced, geometric configured, resonant elements printed on the dielectric substrate and configured and spaced from each other to have a resonant frequency to filter an electromagnetic field at a selected frequency with respect to an angle of incidence to the dielectric substrate; and a dielectric filler positioned between each resonant element printed on dielectric substrate and forming a substantially planar spatial filtering surface, wherein a spatial filter taper transform is imparted when electromagnetic radiation passes therethrough.

29. A spatial filtering surface according to claim 28, wherein said resonant elements are formed by a plurality of wire elements printed on the dielectric substrate.

30. A spatial filtering surface according to claim 29, wherein said wire elements are configured as hexagons.

31. A spatial filtering surface according to claim 28, and further comprising a metallic layer disposed on the dielectric layer, and wherein said resonant elements are formed as geometric configured slots within the metallic layer.

32. A spatial filtering surface according to claim 31, wherein said geometric configured slots are formed as hexagons.

33. A spatial filtering surface according to claim 28, wherein said dielectric substrate comprises a plurality of dielectric layers.

34. A spatial filtering surface according to claim 28, and further comprising a dielectric layer overlying said resonant elements.

35. A spatial filtering surface according to claim 34, wherein said dielectric layer overlying said resonant elements comprises a plurality of dielectric layers.

36. A spatial filtering surface according to claim 28, wherein said filler comprises an adhesive film.

37. A spatial filtering surface according to claim 28, wherein said filler is formed from an air gap between resonant elements.

* * * * *

UNITED STATES PATENT AND TRADEMARK OFFICE

CERTIFICATE OF CORRECTION

PATENT NO. : 6,900,763 B2 
DATED : May 31, 2005
INVENTOR(S) : William D. Killen and Heriberto Delgado It is certified that error appears in the above-identified patent and that said Letters Patent is hereby corrected as shown below:

Column 23,
Line 59, delete “formed am” insert -- formed as --.

Column 24,
Line 10, delete “layer”.

Signed and Sealed this

Twentieth Day of December, 2005

JON W. DUDAS
*Director of the United States Patent and Trademark Office*